US008453760B2

(12) United States Patent
Fincher et al.

(10) Patent No.: US 8,453,760 B2
(45) Date of Patent: Jun. 4, 2013

(54) METHOD AND APPARATUS FOR CONTROLLING BOTTOMHOLE TEMPERATURE IN DEVIATED WELLS

(75) Inventors: Roger W. Fincher, Conroe, TX (US); Larry A. Watkins, Cypress, TX (US); Donald K. Trichel, Houston, TX (US); Marcus Oesterberg, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 63 days.

(21) Appl. No.: 12/862,656

(22) Filed: Aug. 24, 2010

(65) Prior Publication Data

US 2011/0048802 A1 Mar. 3, 2011

Related U.S. Application Data

(60) Provisional application No. 61/236,802, filed on Aug. 25, 2009.

(51) Int. Cl.
*E21B 7/00* (2006.01)
*E21B 47/06* (2012.01)

(52) U.S. Cl.
USPC ..... 175/50; 175/57; 175/48; 175/25

(58) Field of Classification Search
USPC ..... 175/57, 285, 48, 232, 318, 38, 50, 175/17; 73/152.03, 152.43, 152.46
See application file for complete search history.

(56) References Cited

U.S. PATENT DOCUMENTS

| | | | | |
|---|---|---|---|---|
| 3,327,527 | A * | 6/1967 | Arps | 73/152.03 |
| 3,774,701 | A * | 11/1973 | Weaver | 175/17 |
| 4,575,261 | A * | 3/1986 | Berger et al. | 374/136 |
| 4,817,739 | A * | 4/1989 | Jeter | 175/38 |
| 4,926,949 | A * | 5/1990 | Forrest | 175/17 |
| 5,171,139 | A * | 12/1992 | Underwood et al. | 418/48 |
| 5,586,084 | A * | 12/1996 | Barron et al. | 367/85 |
| 5,730,222 | A * | 3/1998 | Rike, Jr. | 166/373 |
| 5,861,362 | A * | 1/1999 | Mayeux et al. | 507/104 |
| 6,349,763 | B1 | 2/2002 | Estep et al. | |
| 6,606,009 | B2 * | 8/2003 | Gunawardana et al. | 331/176 |
| 6,742,603 | B2 | 6/2004 | Polizzotti et al. | |
| 7,108,080 | B2 * | 9/2006 | Tessari et al. | 175/21 |
| 7,111,692 | B2 * | 9/2006 | Hosie et al. | 175/25 |
| 7,114,581 | B2 * | 10/2006 | Aronstam et al. | 175/57 |
| 7,234,540 | B2 | 6/2007 | Estes et al. | |
| 7,334,650 | B2 * | 2/2008 | Giroux et al. | 175/26 |
| 7,395,877 | B2 * | 7/2008 | Hosie et al. | 175/25 |

(Continued)

OTHER PUBLICATIONS

Gonzalez et al., "Managing wellbore temperatures may increase effective fracture gradients," Oil & Gas Journa, vol. 102, Issue 331, Oct. 6, 2004.*

*Primary Examiner* — Kenneth L Thompson
(74) *Attorney, Agent, or Firm* — Cantor Colburn LLP

(57) ABSTRACT

An apparatus and method for reducing temperature along a bottomhole assembly during a drilling operation is provided. In one aspect the bottomhole temperature may be reduced by drilling a borehole using a drill string having a bottomhole assembly at an end thereof, circulating a fluid through the drill string and an annulus between the drill string and the borehole, diverting a selected portion of the fluid from the drill string into the annulus at a selected location above the drill bit to reduce pressure drop across at least a portion of the bottomhole assembly to reduce temperature of the bottomhole assembly during the drilling operation.

18 Claims, 15 Drawing Sheets

U.S. PATENT DOCUMENTS

| | | | | |
|---|---|---|---|---|
| 7,456,135 | B2 * | 11/2008 | Kirsner et al. | 507/103 |
| 7,624,819 | B1 * | 12/2009 | LeBlanc et al. | 175/57 |
| 7,703,513 | B2 * | 4/2010 | Vinegar et al. | 166/245 |
| 7,775,299 | B2 * | 8/2010 | Khan et al. | 175/57 |
| 7,806,203 | B2 * | 10/2010 | Krueger et al. | 175/57 |
| 7,841,425 | B2 * | 11/2010 | Mansure et al. | 175/57 |
| 8,011,450 | B2 * | 9/2011 | Krueger et al. | 175/57 |
| 8,267,197 | B2 * | 9/2012 | Fincher et al. | 175/57 |
| 2002/0108783 | A1 * | 8/2002 | Elkins et al. | 175/25 |
| 2003/0144153 | A1 * | 7/2003 | Kirsner et al. | 507/100 |
| 2004/0084180 | A1 * | 5/2004 | Shah et al. | 166/250.16 |
| 2004/0108138 | A1 | 6/2004 | Cooper et al. | |
| 2004/0112642 | A1 * | 6/2004 | Krueger et al. | 175/57 |
| 2004/0178003 | A1 * | 9/2004 | Riet | 175/57 |
| 2004/0206548 | A1 * | 10/2004 | Aronstam et al. | 175/57 |
| 2004/0256161 | A1 * | 12/2004 | Aronstam et al. | 175/65 |
| 2005/0034898 | A1 * | 2/2005 | Naquin | 175/65 |
| 2005/0098349 | A1 * | 5/2005 | Krueger et al. | 175/25 |
| 2005/0247487 | A1 * | 11/2005 | Mellott | 175/57 |
| 2006/0108123 | A1 * | 5/2006 | De Lucia et al. | 166/380 |
| 2006/0212223 | A1 * | 9/2006 | Azari | 702/6 |
| 2006/0235618 | A1 * | 10/2006 | Wu et al. | 702/6 |
| 2006/0254822 | A1 * | 11/2006 | Ayling | 175/57 |
| 2007/0007041 | A1 * | 1/2007 | Krueger et al. | 175/57 |
| 2007/0045006 | A1 * | 3/2007 | Krueger et al. | 175/25 |
| 2007/0068704 | A1 * | 3/2007 | Krueger et al. | 175/57 |
| 2007/0068705 | A1 * | 3/2007 | Hosie et al. | 175/57 |
| 2007/0163809 | A1 * | 7/2007 | Mackay et al. | 175/57 |
| 2007/0227774 | A1 * | 10/2007 | Reitsma et al. | 175/25 |
| 2008/0115971 | A1 * | 5/2008 | Kelleher et al. | 175/5 |
| 2008/0245574 | A1 * | 10/2008 | Campbell et al. | 175/57 |
| 2008/0264690 | A1 * | 10/2008 | Khan et al. | 175/25 |
| 2008/0302569 | A1 * | 12/2008 | deBoer | 175/25 |
| 2008/0302570 | A1 * | 12/2008 | deBoer | 175/25 |
| 2008/0302571 | A1 * | 12/2008 | Mondelli et al. | 175/57 |
| 2009/0107675 | A1 * | 4/2009 | Eriksen et al. | 166/285 |
| 2009/0133867 | A1 * | 5/2009 | Kuckes | 166/65.1 |
| 2009/0145660 | A1 * | 6/2009 | Johnson et al. | 175/25 |
| 2009/0194330 | A1 * | 8/2009 | Gray | 175/24 |
| 2009/0272580 | A1 * | 11/2009 | Dolman et al. | 175/48 |
| 2010/0153014 | A1 * | 6/2010 | Kischkat et al. | 702/6 |

* cited by examiner

900

| Position | Mud Flow From Pump | Valve | Bypass Flow |
|---|---|---|---|
| 1 | 100% | Closed | 0% |
| 2 | 40% | Open | x % |
| 3 | 100% | Open | 70% |
| 4 | 20 | Closed | 0% |

Figure 9

METHOD AND APPARATUS FOR CONTROLLING BOTTOMHOLE TEMPERATURE IN DEVIATED WELLS

CROSS-REFERENCE TO RELATED APPLICATIONS

This application claims priority to provisional patent application Ser. No. 61/236,802, filed Aug. 25, 2009.

BACKGROUND OF THE DISCLOSURE

1. Field of the Disclosure

This disclosure relates generally to drilling of lateral wellbores for recovery of hydrocarbons, and more particularly to maintaining temperature of a bottomhole assembly below certain threshold temperature.

2. Description of the Related Art

To obtain hydrocarbons such as oil and gas, boreholes are drilled by rotating a drill bit attached at a drill string end. The drill string may include a jointed rotatable pipe or a coiled tube. Boreholes may be vertical, deviated or horizontal. A drilling fluid (also referred to as "mud) is pumped from the surface into the drill string, which fluid discharges at the drill bit bottom and circulates to the surface through the annulus between the drill string and the borehole. Modern directional drilling systems generally employ a bottomhole assembly (BHA) and a drill bit at an end thereof. The drill bit is rotated by rotating the drill string from the surface and/or by a drilling motor (also referred to as the "mud motor) disposed in the BHA. A number of downhole devices placed in close proximity to the drill bit measure a variety of downhole operating parameters associated with the BHA. Such devices typically include sensors for measuring: temperature, pressure, tool azimuth, tool inclination, bending, vibration, etc. measurement-while-drilling (MWD) devices (or tools) or logging-while-drilling (LWD) devices (or tools) are frequently used as part of the BHA to determine formation parameters, such as formation geology, formation fluid contents, resistivity, porosity, permeability, etc. Such devices include sensor elements, electronic components and other components that are rated to operate properly below a temperature limit, typically 150° C.

The temperature along the BHA during drilling operations, particularly in long horizontal boreholes, may be higher than the formation temperature. In long horizontal boreholes, the borehole circulating temperature (BHCT) sometimes rises above a static temperature and often above the acceptable upper temperature limit. For the purposes of the present disclosure, the term "drilling operation" is intended to include all operations in which the BHA is in the borehole. Included in such operations are situations period during which: the drill bit is drilling the borehole and the drill bit is set off the borehole bottom with or without mud circulation through the drill string and the borehole annulus. The increase in BHCT during drilling operations is at least in part attributable to the fact that the thermal equivalent of the work done downhole increases temperature of the borehole fluid, which in turn increases the temperature of the fluid circulating about the BHA and thus temperature of the BHA. Also, an increase in BHCT above static geothermal gradient increases the temperature of the formation rock near the borehole wall. This can result in increased compressive hoop stress in the borehole wall due to thermal expansion. The increased stress on the borehole wall can lead to failure of the borehole wall.

Therefore, it is desirable to provide apparatus and methods that will reduce the bottomhole assembly temperature during drilling operations.

The present disclosure provides apparatus and methods that address some of the above-noted and other needs.

SUMMARY

One embodiment of the disclosure is a method of conducting a drilling operation in a borehole. In one aspect, the method may include: conveying a drillstring having a tubular, a bottomhole assembly (BHA), and a drill bit at an end of the BHA into the borehole; supplying a fluid under pressure from a surface location through the tubular during the drilling operation, the fluid passing through the drill bit and discharging into an annulus between the BHA and a wall of the borehole, wherein the drilling operation results in an increase in a temperature of the fluid in the annulus; and selectively diverting a portion of the fluid from the drillstring at a location above the drill bit into the annulus to reduce the temperature of BHA during the drilling operation.

Another embodiment of the disclosure provides apparatus for conducting a drilling operation in a borehole. In one embodiment, the apparatus may include: a drill string including a bottomhole assembly (BHA) carrying a drill bit at an end thereof; a surface source configured to supply a fluid under pressure through the drillstring and the drill bit into an annulus between the BHA and a wall of the borehole during the drilling operation, wherein the drilling operation results in an increase in a temperature of the fluid in the annulus; and a flow control device above the drill bit configured to selectively divert the flow of fluid in the drillstring to the annulus to reduce the temperature of the temperature of BHA during the drilling operation.

Examples of certain features of apparatus and methods have been summarized rather broadly in order that the detailed description thereof that follows may be better understood. There are, of course, additional features of the apparatus and method disclosed hereinafter that will form the subject of the claims made pursuant to this disclosure.

BRIEF DESCRIPTION OF THE DRAWINGS

For detailed understanding of the present disclosure, reference should be made to the following detailed description taken is conjunction with the accompanying drawings in which like elements have generally been given like numerals and wherein:

FIG. 9 shows a schematic diagram of a mechanical flow control device for circulating drilling fluid from the drill string to the annulus during a drilling operation;

DESCRIPTION OF THE EMBODIMENTS

Figure 1:
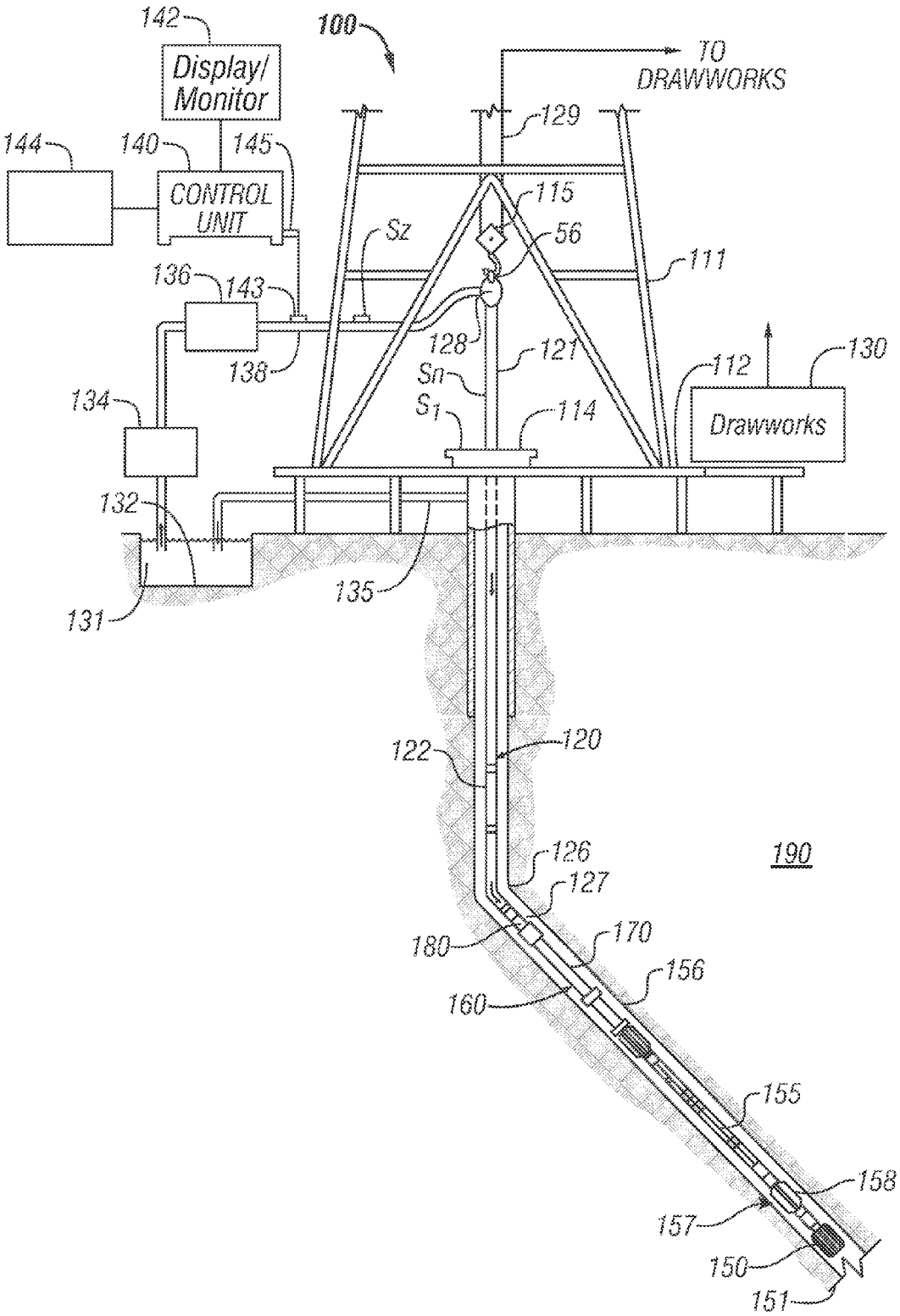
FIG. 1 shows a schematic diagram of a drilling system according to one embodiment of the disclosure.

FIG. 1 shows a schematic diagram of a drilling system 100 configured to drill a borehole 126 according to one embodiment of the disclosure. System 100 is shown to include a conventional derrick 111 erected on a derrick floor 112 that supports a rotary table 114 rotated by a prime mover (not shown) at a desired rotational speed to rotate a drill string 120. Alternatively, the drill string 120 may be rotated by a top drive (not shown). The drill string 120 includes a jointed drilling tubulars or pipe 122, BHA 160 and a drill bit 150 at the downhole end of the BHA 160 extends downward from the rotary table 114 into the borehole 126. The drill bit 150 disintegrates the geological formations when rotated. The drill string 120 is coupled to a drawworks 130 via a kelly joint 121, swivel 128 and line 129 through a system of pulleys 115. During drilling operations, the drawworks 130 is operated to control the weight on bit and the rate of penetration of the drill string 120 into the borehole 126.

During drilling operations a suitable drilling fluid (also referred to as "mud") 131 from a mud pit 132 is circulated under pressure through the drill string 120 by a mud pump 134. The drilling fluid 131 passes into the drill string 120 via a desurger 136, fluid line 138 and the kelly joint 121. The drilling fluid 131 discharges at the borehole bottom 151 through openings in the drill bit 150. The drilling fluid circulates uphole through the annular space (annulus) 127 between the drill string 120 and the borehole 126 and discharges into the mud pit 132 via a return line 135. A variety of sensors (S1-Sn) may be appropriately deployed on the surface to provide information about various drilling-related parameters, including, but not limited to, fluid flow rate, weight-on-bit (WOB), hook load, drill string rotational speed (RPM), and rate of penetration (ROP) of the drill bit 150.

A surface control unit (or surface controller) 140 receives signals from the downhole sensors and devices via a sensor 143 placed in the fluid line 138 and processes such signals according to programmed instructions provided to the surface control unit 140. The surface control unit 140 displays desired drilling parameters and other information on a display/monitor 142, which information is utilized by an operator to control the drilling operations. The surface control unit 140 may include a computer, data storage device (memory) for storing data, computer programs and simulation models, data recorder and other peripherals. The surface control unit 140 accesses data and models to process data according to programmed instructions and responds to user commands entered through a suitable medium, such as a keyboard. The surface control unit 140 may be adapted to communicate a remote computer unit 144 by a suitable communication link, such as the internet, wireless signals, Ethernet, etc. As discussed below, the surface control unit 140 and/or a downhole control unit (or downhole controller) 170 may be utilized to control drilling operations and the operations of the BHA 160.

A drilling motor (or mud motor) 155 coupled to the drill bit 150 via a shaft (not shown) disposed in a bearing assembly 157 rotates the drill bit 150 when the drilling fluid 131 passes through the mud motor 155 under pressure. The bearing assembly 157 supports the radial and axial forces of the drill bit 150, the down thrust of the drilling motor 155 and the reactive upward loading from the applied WOB. A stabilizer 158 coupled to the bearing assembly 157 acts as a centralizer for the lowermost portion of the mud motor assembly.

In aspects, the BHA 160 may include various sensors and MWD devices to provide information about various parameters relating to the drill string 120, including the BHA 160, borehole 126 and the formation 190. Such sensors devices may include, but, are not limited to, resistivity tools, acoustic tools, nuclear tools, nuclear magnetic resonance tools, formation testing tools, accelerometers, gyroscopes, and pressure, temperature, flow and vibration sensors. Such sensors and devices are known in the art and are thus not described in detail herein. A two-way telemetry device 180 may be utilized to communicate data between the surface controller 140 and the downhole controller 170. Any suitable telemetry system may be utilized, including, but not limited to, mud pulsed telemetry, wired-pipe (electrical wire and/or optical fiber wired) telemetry, electro-magnetic telemetry and acoustic telemetry. As noted earlier, the sensors, MWD devices and other materials in the BHA include temperature-sensitive components. The BHA 160 typically can exceed 60 meters in length. The pressure drop across the drill string 120 varies depending upon the mud pump 134 flow, pressure drop across the BHA, including the drilling motor 155, flow fluid friction and other factors. The pressure drop across the BHA 160 is often 30-40% of the total pressure drop and can be 1200-1600 psi. In aspects, system 100 is configured to selectively reduce pressure across the drill string 120, BHA 160 and/or certain other sections of the drill string 120 to reduce temperature or manage thermal distribution along the BHA 160 during a drilling operation. In one aspect this may be accomplished by activating a flow control device 156 at a suitable location in the drill string to selectively circulate (discharge or divert) the fluid flowing from the drill string to the annulus 127. Any suitable flow control device may be utilized for the purposes of this disclosure. Certain exemplary flow control devices are described in more detail later. Such devices also are referred to as bypass devices. Any of such devices may be formed as a separate assembly (referred to in the art as a "sub") that may be placed at any suitable location in the drill string 120.

Figure 2:
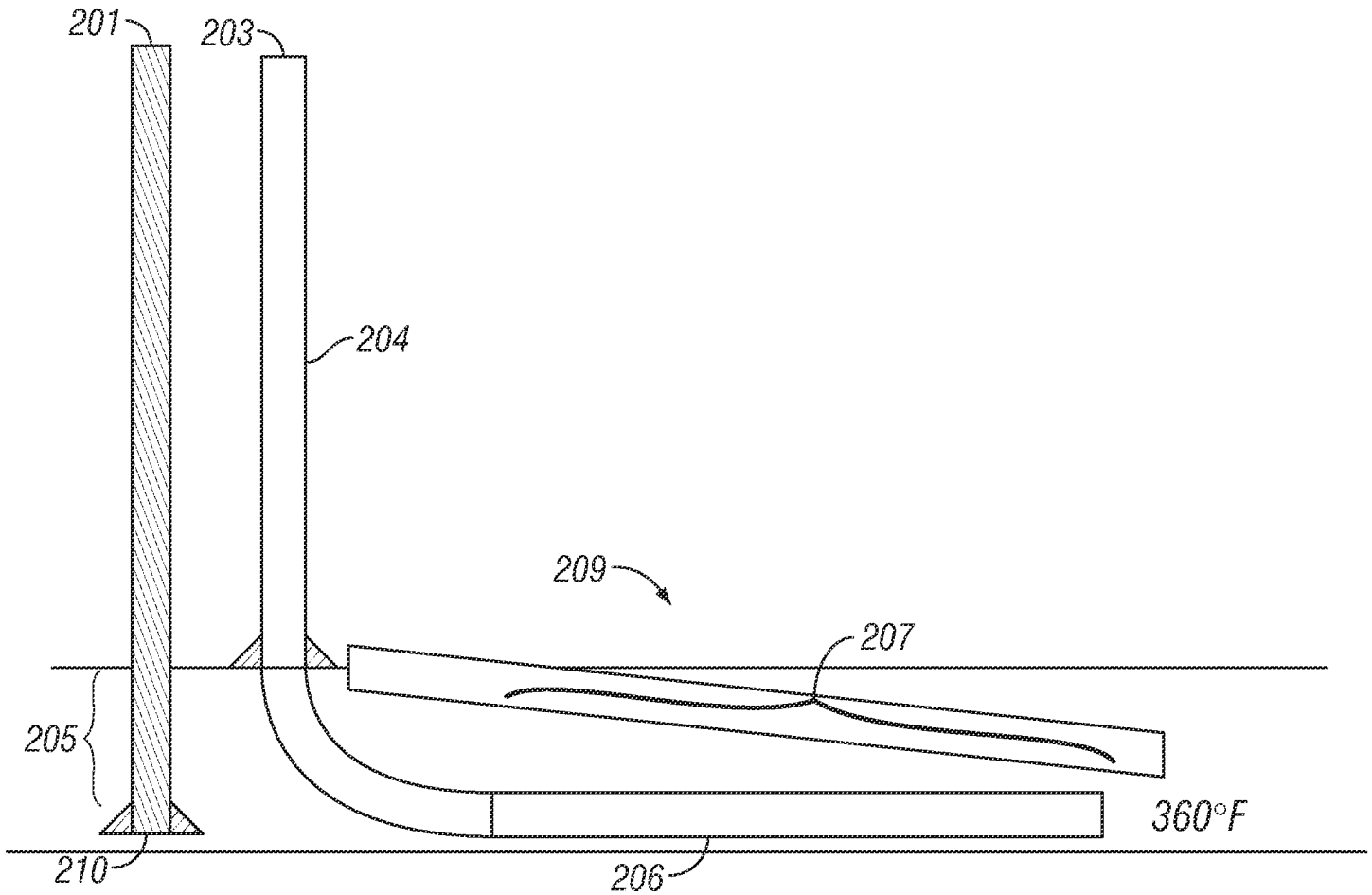
FIG. 2 schematically depicts an example of high temperature exposure to the BHA along vertical borehole and a horizontal borehole corresponding to the same true vertical depth.

Before describing details of the apparatus and methods for reducing or managing thermal distribution along the BHA during drilling operations in horizontal or deviated boreholes, thermal distribution during conventional drilling operations is described. FIG. 2 schematically depicts an example of high temperature exposure to the BHA along a vertical borehole and a horizontal borehole corresponding to the same true vertical depth. FIG. 2 shows a substantially vertical borehole 201 drilled to a true vertical depth (TVD) 210 and a borehole 203 that includes a vertical segment 204 a curved segment and a substantially horizontal section 206 placed at the TVD 210. Both of the boreholes 201 and 203 are shown to penetrate a region of the earth formation with a boundary denoted by 209, where the temperature exceeds 350° F. (approximately 175° C.) The length 207 of the deviated borehole 206 that encounters the high temperatures is substantially greater than the length 205 of the vertical borehole 201 that encounters the high temperatures at the same TVD. Therefore, a BHA is subjected to high temperatures for a substantially extended time period during drilling of the horizontal borehole compared to the drilling of the vertical borehole to the same TVD.

Figure 3A:
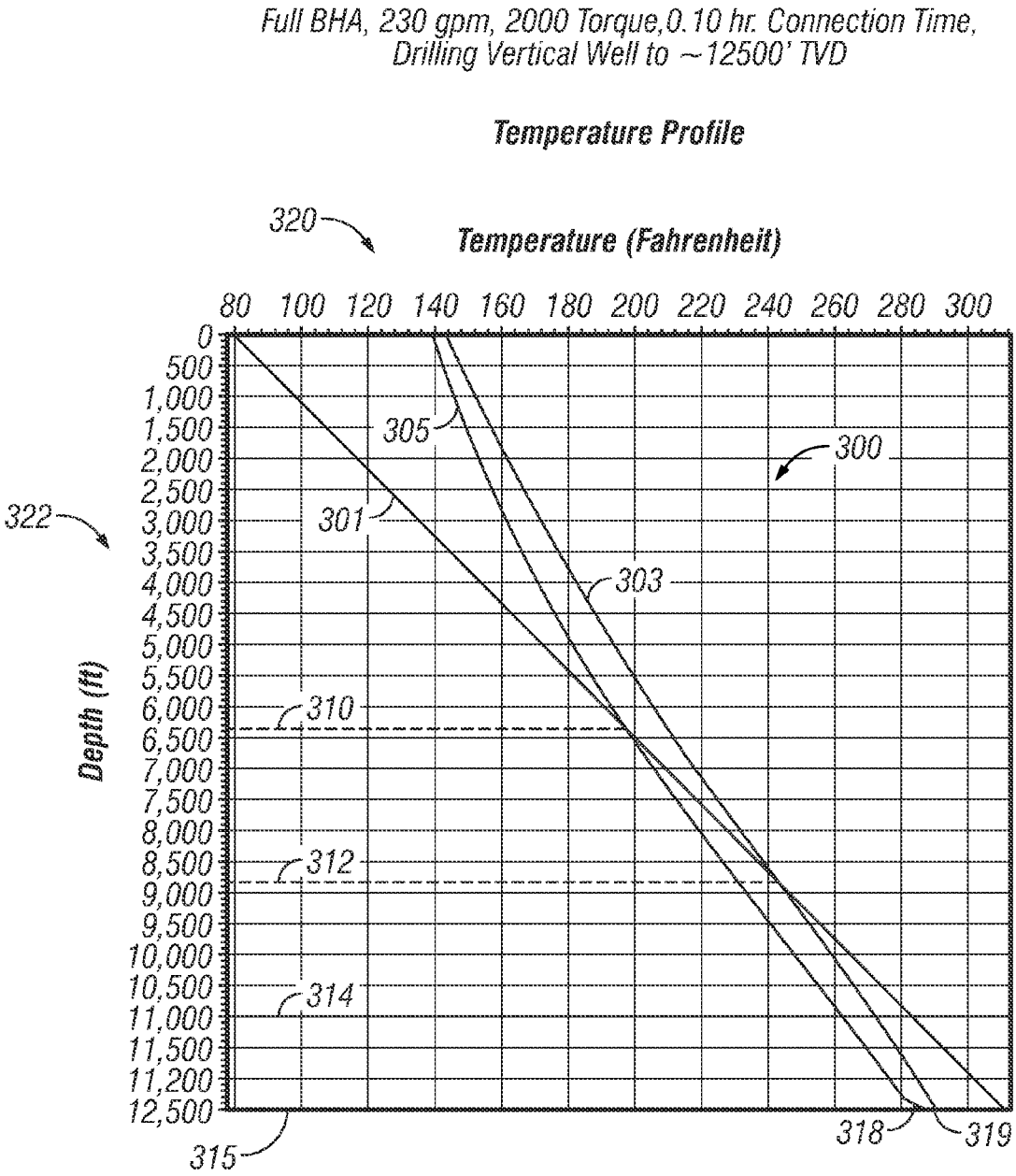
FIG. 3*a* shows exemplary simulated temperature profiles of a BHA, annulus and the formation for a vertical borehole as a function of drilling depth.

FIG. 3*a* shows a graph 300 of simulated temperature profiles of a formation, drill string and the annulus fluid during drilling of a vertical borehole to a true vertical depth (TVD) 315 of 12,500 ft. The temperature is shown along the horizontal axis 320 and the wellbore depth is shown along the vertical axis 322. Curve 301 corresponds to the temperature of the formation, curve 303 corresponds to the temperature of the circulating fluid in the annulus between the drill string and the formation and curve 305 corresponds to the temperature of the fluid in the drill string when the drill bit is proximate the borehole bottom. The simulated graph 300 corresponds to a BHA that includes a variety of MWD devices and other sensors. The drilling parameters include a drilling fluid pumped at the surface at the rate of 230 gallons per minute with a torque of 2000 ft-lbs required to rotate the drillstring at the surface. The connection time (time to add a pipe section of about 100 ft in length) is assumed to be one tenth of an hour and the rate of penetration (ROP) of about 30 feet per hour. In the particular example of FIG. 3*a*, the formation temperature increases with the borehole depth substantially linearly. At depth 310, the BHA temperature 305 crosses the borehole temperature 301 and continues to decrease relative to the borehole temperature as the borehole depth increases. At depth 312 the annulus fluid temperature 303 crosses over the formation temperature 301 and continues to decrease relative to the formation temperature as the borehole depth increases. The temperature of the annulus remains higher than the temperature inside the BHA because the circulating fluid in the annulus carries away the heat generated by the drilling process, i.e. by pressure drop created across the drill string, including the pressure drop across the BHA.

Figure 3B:
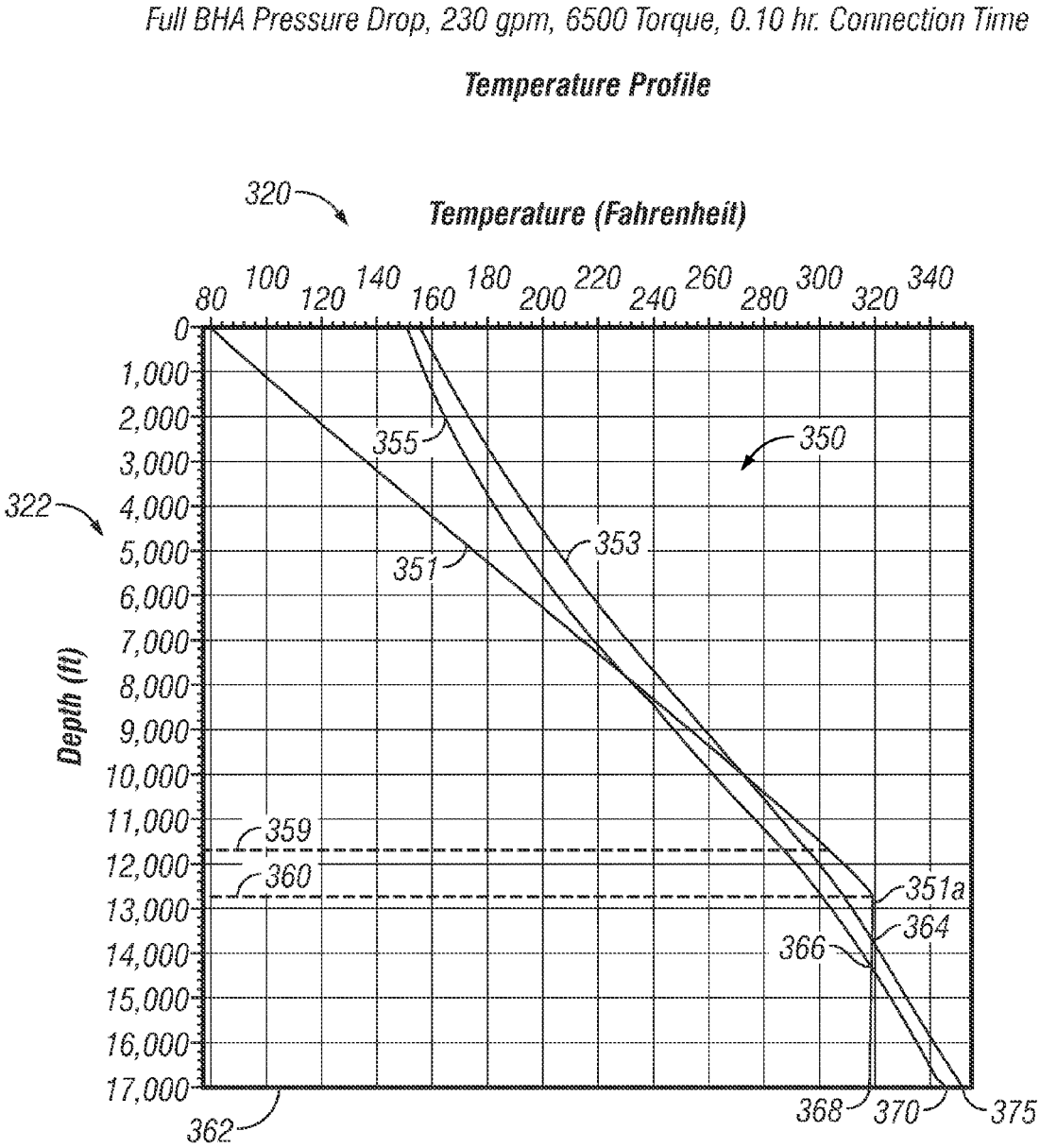
FIG. 3*b* shows exemplary simulated temperature profiles of a BHA, annulus and the formation for a horizontal borehole as a function of drilling depth.

FIG. 3*b* shows a graph 350 of simulated temperature profiles of formation, drill string fluid and the annulus fluid during drilling of a well drilled to vertical depth 359 and then transitioned to a horizontal wellbore to drilling depth 362 at TVD 360. The drilling parameters used for the simulation shown in graph 350 are the same as those used for graph 300, except that torque required to rotate the drillstring at the surface is 6500 ft-lbs instead of 2000 ft-lbs for the vertical well in FIG. 3*a*. Curve 351 corresponds to the temperature of the formation, curve 353 corresponds to the temperature of the circulating fluid in the annulus between the drill string and curve 355 corresponds to the temperature of the drilling string fluid, when the drill bit is proximate to the borehole bottom. The temperature profiles of the formation 351, drill string 355 and the annulus fluid 353 generally follow the temperature profiles shown in FIG. 3*a* for the vertical portion of the borehole. Since at drilling depth 360 (about 12,500 ft TVD) the borehole becomes substantially horizontal, all the drilling depths greater than depth 360 are at the same TVD. To the extent the static formation temperature depends only on the TVD, there is no further increase in the temperature 368 of the formation (approximately 315° F.). Therefore, from depth 360, the formation temperature is substantially constant, as shown by the vertical line 351*a*. The bottomhole assembly and annulus fluid temperatures continue to increase as the borehole depth increases. The annulus fluid temperature becomes greater than the formation temperature at depth 364, while the bottomhole assembly temperature becomes greater than the formation temperature at depth 366. The temperature 370 of the BHA at depth at 362 (TVD of 12,500 ft as shown at depth 315 in FIG. 3*a*) is about 340° F., while the temperature 318 of the BHA in the vertical borehole (FIG. 3*a*) at depth 315 is about 283° F. Similarly, the temperature 375 in the annulus of the horizontal borehole at depth 362 is about 347° F. while in the vertical borehole the temperature 319 is about 290° F. (FIG. 3*a*). It is further to be noted that the temperature 375 in the BHA at depth 362 has exceeded the typical upper temperature limit for BHA components.

Elevation of the borehole circulation temperature (BHCT) occurs because, in long horizontal boreholes, heat transfers from the annulus fluid to the drill string and drilling string fluid both during drilling and during the time period that the next stand of drill pipe is added. Typically, the BHA is pulled off bottom and the fluid is circulated for 5 to 20 minutes before the connection is made. During this time, hot fluid in the annulus circulates back down the horizontal borehole and the heat in the fluid in the annulus flows across the drill pipe and into the drill string fluid which increases the BHA temperature. Since the fluid flow through the BHA continues, the pressure drop across the BHA also continues, adding additional heat to the system. During this off bottom circulation period before the drill pipe stand is added, BHA pressure drop remains and therefore heating of the fluid continues. While the mud motor pressure drop associated with on bottom drilling may be 400 to 600 psi, it can remain in the range of 200 to 300 psi when in the off bottom condition, as part of the 800 psi to 1000 psi of the pressure drop that remains in the BHA any time fluid is circulating through the BHA. When the BHA is off the bottom of the borehole (i.e., no WOB and no drilling), a large part of the total pressure drop remains. While the heat generated by the drilling motor pressure drop no longer contributes to the annular heating, the remaining BHA pressure drop continues to generate heat, thereby continuing to add heat to the annular fluid.

Description of the energy balance is useful background in understanding the thermal distribution along the drill string. From energy balance stand point, two main sources of energy involved in the drilling of a borehole. The first source of energy is the rotational energy imparted to the drillstring at the surface. In a borehole, some of this mechanical energy is used to overcome frictional forces acting on the drill string and some of it used by the drill bit in the process of cutting into the formation. The frictional energy utilized to rotate the drillstring is converted into heat. The frictional forces in a deviated or horizontal borehole are substantially greater than those in a vertical borehole. The higher frictional forces generate increased amounts of heat. This, in turn, increases the temperature of the fluid in the drilling tubular, BHA and the annulus fluid.

The second source of energy for drilling is provided by the mud pumps. The net power input of the mud pumps to the drilling process is the product of the pressure differential at the top of the tubing and the surface annulus, and the flow rate. This may be represented as $$\text{Power}=\Delta P\times\text{Flow}. \quad (1).$$

This may be referred to as hydraulic power and its cumulative value over time as hydraulic energy.

The energy required in the form of the kinetic energy to lift the drill cuttings out of the borehole is relatively small compared to the energy input in the mud flow. Thus, in order to maintain the energy balance, substantially all of the energy input into the borehole is converted to heat. For the purposes of the present disclosure, any component that consumes hydraulic power or creates a pressure drop is defined as a hydraulic heat source. The heat produced by a hydraulic heat source is given by equation (1). Therefore, any change in either the flow rate or the differential pressure will cause a change in the heat input to the system and thus have the potential for altering the BHCT. Similarly, the mechanical power input to the drilling system may be given by the product of the rotational speed (rpm) of the drillstring and the torque at the wellhead and is given by equation 2, again most if not all of this power becomes heat in the wellbore.

$$\text{Power}=\text{Torque}\times\text{RPM}. \quad (2).$$

Frictional losses due to drillstring rotation are intrinsically greater in deviated boreholes than in vertical boreholes. These are generally distributed throughout the length of the drillstring and will account for some proportion of the higher temperatures noted below 8,000 ft in the BHA and the annulus for deviated borehole, as shown in FIG. 3*b*.

Drilling operations include pauses during which circulation of mud is stopped or reduced, and/or the weight-on-bit (WOB) is reduced, possibly to zero. One reason for these pauses is the time required to add a new stand or section of drill pipe during drilling or, similarly, the time required to remove a stand of drill pipe during tripping the drill string out of the borehole. In addition, some formation evaluation measurements (such as NMR measurements and seismic-while-drilling measurements) benefit from reduced motion of the BHA. Such measurements are often made when the BHA is stationary while a stand of drill pipe is not being added or removed.

The effect of such pauses is discussed next with reference to an exemplary driller's log 400 for a horizontal borehole shown in FIG. 4. The ordinate for all the curves is time. Curve 401 shows the block height (associated with the swivel 128). The curve 403 is the static bottomhole temperature and represents the temperature of the formation, the annulus, the tubing and the BHA under static (no circulation) equilibrium conditions at the TVD of the horizontal section of the well. Curve 405 gives the actual BHCT measured by a temperature sensor inside the BHA. Curve 407 provides the strokes per minute ("spm") [volume of fluid} for the mud pump 134 during pumping of the drilling fluid into the borehole. Curve 409 shows the difference in pressure between the drill string being operated on the bottom of the borehole and circulating off bottom with low or zero weight on the bit. The difference essentially represents the differential pressure consumed by the downhole motor 155 during the act of drilling. The rate of penetration (ROP) of the drill bit 150 is shown by 413. Curve 415 is the thermal equivalent (in BTU) of the mechanical power input (torque×rpm) at the surface given by equation (2), 417 is the thermal equivalent of the hydraulic power input given by equation (1) and curve 419 is the thermal equivalent of the total power input, i.e., the sum of values shown in curves 415 and 417.

Figure 4:
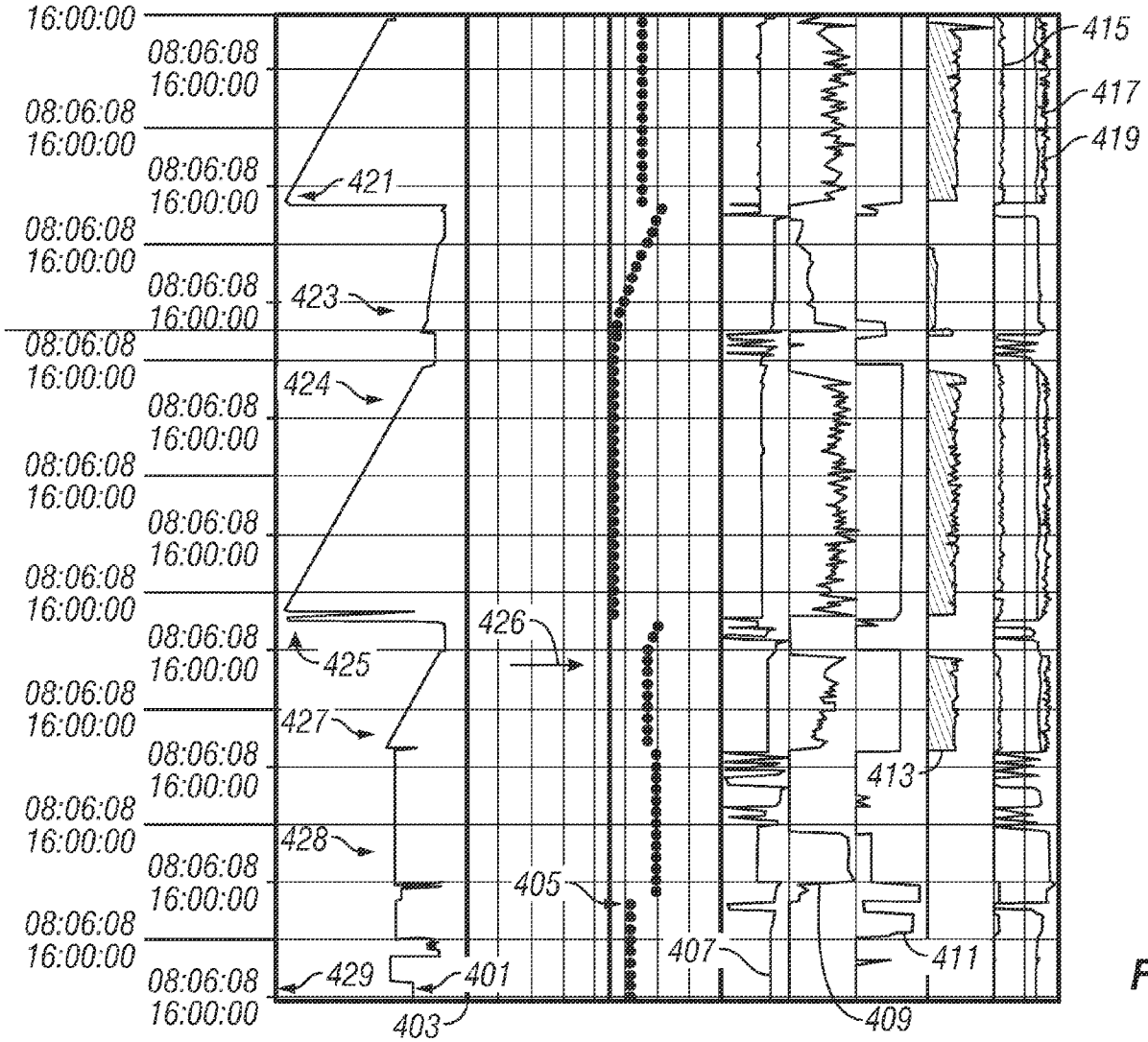
FIG. 4 shows a section of a drilling log illustrating certain factors that affect the temperature of a BHA during drilling operations.

FIG. 4 shows that over the time interval before time point 421, the block height steadily decreases. The BHCT 405 is steady at 324° F., the pump rate is steady at 60 spm, the ΔP (pressure differential) fluctuates around 400 psi, the string rotation is 60 rpm, the ROP is around 40 ft./hr. At the time indicated by time point 421, the pump is stopped for a short time interval (the pump speed of zero spm 407 goes off scale below 50 spm), and the ΔP (409) is zero psi. The block height 421 is raised in preparation for adding a new drill pipe stand or section. After the short interval, the pump is restarted (407 is 65 spm), and ΔP reaches to about 200 psi.

Still referring to FIG. 4, an immediate spike in the BHCT 405 to 331° F. is noted when the pump is restarted and the ΔP is increased. The temperature decreases to the dynamic (circulating) equilibrium value at time point 423. The spike in the BHCT is about 7° F. above the dynamic equilibrium BHCT 405 prior to the pump off event at point 421. During the time interval between time points 421 and 422, the ROP is zero and the block height is constant indicating an off bottom circulation event, i.e., the circulation of the mud during this time interval continues to lower the BHCT 405. Between time point 422 and 423, drilling is resumed in a slide only mode whereby the power to the drill bit is provided solely by the mud motor 155 without drill string rotation 411 from the surface 114. The slide drilling operation utilizes lower WOB reduced differential pressure 409 and results in a lower ROP 413 and therefore as discussed previously, a reduced amount of thermal equivalent energy is input into the system from hydraulic power 417,419. It can be seen that the slide drilling lowers the BHCT to a new lower dynamic equilibrium BHCT of 315° F. 405. At time point 424, drill string rotation is resumed (as indicated by the RPM curve 411 and the ROP curve 413). Circulation is continuous, therefore no rise in temperature or spike occurs between time point 424 and the addition of the next drill pipe stand at time point 425.

At time point 425, the mud flow is interrupted to add the next drill pipe section, the BHCT 405 spikes to about 330° F. and remains elevated even after circulation and drilling are resumed. At time point 427, the mud pumps are cycled as part of the drilling process, as is indicated by the behavior of 407 and 409. At time point 428, normal circulation is resumed. The BHCT 405, however, stays elevated until the end of the time interval even though the ROP 413 is zero. During the interval from 428 to 429, the thermal equivalent of the mechanical power 415 is close to zero, but the thermal equivalent of the hydraulic power 417 is still high, which adds heat to the borehole environment.

The spike in the BHCT upon restarting the pumps after a stand is added in long horizontal boreholes (noted above) enables heat to transfer from the annulus fluid to the tubing fluid across the tubing or drillstring during the time period directly after the stand has been drilled down. As noted above, during circulation off bottom, while the heat contribution of the motor differential pressure is reduced compared to on bottom drilling, the remaining BHA pressure drop continues to raise the temperature of the fluid flowing across the BHA, thereby continuing to add heat to the annular fluid.

As noted above, an extended period of circulation time (with no ROP) is typically needed to decrease the BHCT to acceptable levels using conventional drilling practices. The extended period of time during which the ROP is substantially zero represents non-productive time (NPT).

Figure 5:
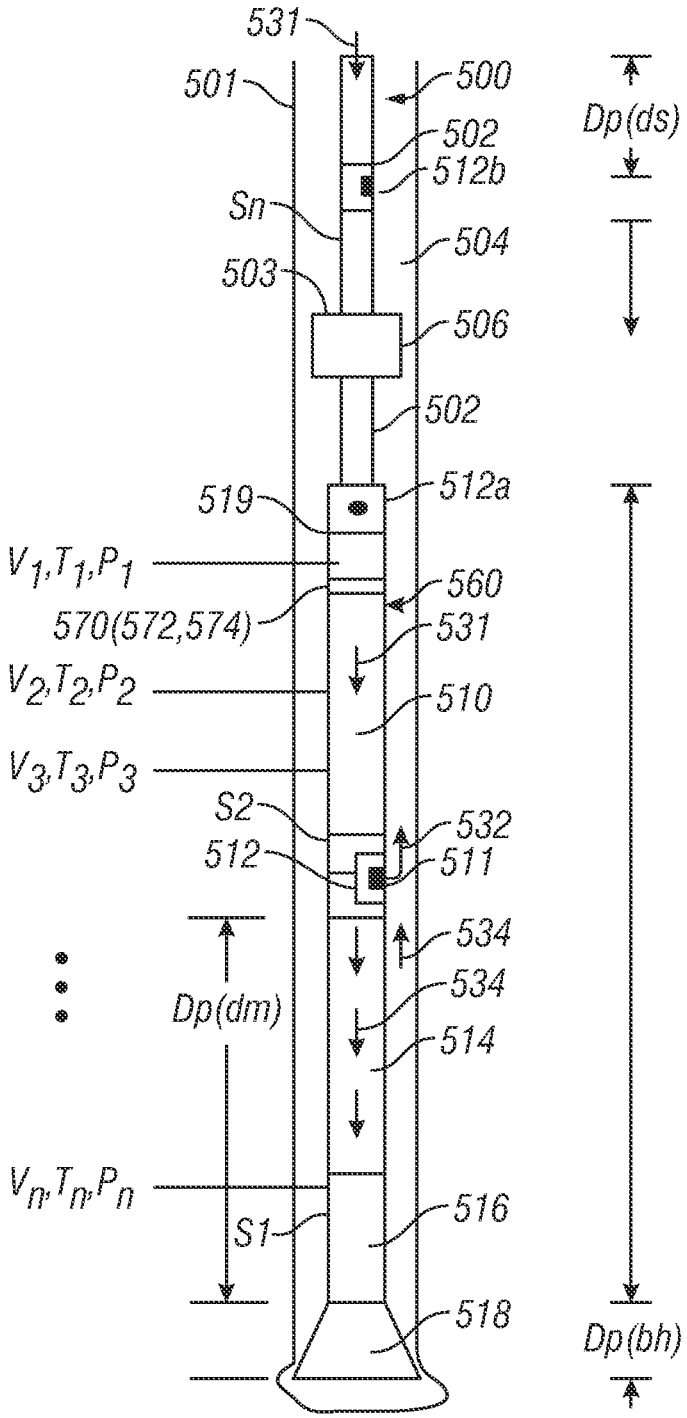
FIG. 5 schematically depicts certain details of a BHA with a flow control device according to one embodiment of the disclosure to reduce temperature of a BHA during drilling operations.

FIG. 5 shows a schematic of a drill string 500 in a wellbore 501 that may be utilized to reduce the temperature of the drilling assembly, drilling tubing and the annulus circulating fluid during a drilling operation, according to one embodiment of the disclosure. The drilling operation includes: drilling the borehole and a pause (circulating drilling fluid without drilling or adding or removing a pipe section). The drill string 500 is shown to include a drilling tubular 502 having a BHA 560 attached to its bottom end 503. For simplicity and ease of explanation of various aspects of thermal management during a drilling operation, details of BHA components are not shown. The BHA 560 is shown to include a mud motor 514 and a steering section 516 coupled to the drill bit 518. The BHA 560 also includes section 510 that includes MWD devices. The upper section 519 of the BHA 560 may include other tools, such as tools to generate electrical power and telemetry tools to provide two-way communication between and among various tools and sensors in the BHA and the surface controller 140 (FIG. 1). The BHA 560 further may include a controller 570 that includes a processor 572 configured to process data from the various sensors and devices in the BHA 560 and to control one or more operations of the devices in the BHA 560. Controller 570 also includes a storage device 574 such as solid state memory that has stored therein data, computer programs and models for use by the processor 572 to perform a variety of operations as described herein. During drilling operations, hydraulic loads (pressure drops or pressure differentials) are present along the drill string 500 and the borehole 501. As an example, the pressure drop across the drill string is shown by Dp(ds), the pressure drop across the BHA 560 and drill bit 518 by Dp(bh), the pressure drop across the mud motor 514 and drill bit 518 by Dp(dm) The upper sections 510, 570 and 519 of the BHA typically represent less hydraulic load than the lower sections 514, 516, 518 of the BHA 560. In aspects, the drill string 500 may also include a hydraulic load 506, such as a device configured to vibrate a drill string section to cause the drill string 500 to remain in a dynamic friction mode in the borehole rather than in a static friction mode. Using a hydraulic load, however, may also add to the wellbore, which may not be desirable under certain conditions. Alternatively, the drill string may be torsionally rocked or twisted at the surface, which method typically does not add significant heat into the wellbore. In such a case, hydraulic load may not be used.

Still referring to FIG. 5, in aspects, the drill string 500 may include a flow control device 512 (also referred to herein as a "circulation sub" or "flow device") having a bypass vent 511 configured to discharge or circulate a selected amount of the fluid 531 flowing through the drill string 500 into the annulus 504 as shown by arrow 532. The remaining fluid 534 continues to flow through the portion of the drill string below or downhole of the flow control device 512. Additionally, one or more sensors (S1, S2, S3 . . . Sn) may be provided at selected locations along the drill string 500 to provide measurement of parameters that may be useful in managing the temperature gradient along the drill string. Such parameters may include, but are not limited to, temperature, pressure, flow rate, pressure differential, WOB, ROP, thermal drop, thermal gradient, and work rate (e.g., time-based volume of rock cut by the drill bit per unit time or drilling depth). In one aspect, the flow device 512 may be placed between the mud motor 514 and MWD devices 510. This section from the mud motor to the drill bit tends to include the largest hydraulic load during drilling. In another embodiment the flow device 512 may be placed above the BHA, as shown by 512*a*. In yet another embodiment, the flow device may be placed above the load device 506 as shown by 512*b* or at another suitable location. Also, more than one control device may be utilized along the drill string 500.

For the purposes of this disclosure any suitable flow control device may be utilized, including, but not limited to, a mechanical device and an electrically controlled device. Exemplary flow control devices are described later. In each case, the flow control device is used to divert the fluid flowing through the drill string to the annulus, thereby reducing the pressure drop across the section below or downhole the flow device. In aspects, the flow control device may allow a portion of the fluid in the drill string to continue to circulate below the flow control device at desired flow rates. The flow control device, in aspects, may have a low pressure drop due to its own operation. The operation of the flow control device 512 is described below. For the purpose of this disclosure, the term "above" means "uphole" or away from the drill bit.

During a drilling process, various drilling operation modes occur. One such mode is a drilling mode, wherein the drill bit 518 under a WOB is rotating to cut the rock formation. In the drilling mode, the WOB and the fluid pumped into the drill string 500 from the surface are controlled at the surface. Drill bit RPM is a based of the rotation of the drill string 500 from the surface and/or the mud motor 514 rotation speed. The drill bit ROP depends upon the WOB, rotational speed of the drill bit, fluid flow rate and the rock properties.

Lack of thermal gradient along the horizontal borehole reduces the amount of circulation fluid available to cool the horizontal borehole. As noted previously, in long horizontal boreholes, the BHA temperature may be higher than the formation temperature. The pressure drop across the BHA 560 (largely due to the pressure drop across the mud motor, other tolls in the BHA and the drill bit) is typically relatively large in comparison to the total pressure drop across the drill string in the horizontal section 500 and thus contributes to the generation of substantial amounts of heat. Accordingly, in one aspect, the disclosure provides for reducing the pressure drop across the drill string 500 and thus the BHA 560 to manage or decrease the temperature along the BHA 560 during the drilling mode. In one aspect, the disclosure provides for reducing the fluid flow through the BHA 560 relative to the total fluid flow 531 into the drill string. Reducing the fluid flow rate through the BHA 560 reduces the pressure drop across BHA 560 and thus the temperature of the BHA 560. However, sufficient fluid flow rate through the mud motor is maintained to rotate the drill bit 518 for efficient drilling of the borehole. A suitable fluid bypass location may be between mud motor 514 and the MWD devices 510. In such a case, the pressure drop across the mud motor 514 decreases, which reduces the temperature generated by the mud motor 514 in the BHA 560. In some cases, the fluid flow rate through the mud motor 514 may be decreased to reduce the pressure drop across the mud motor 514 by up to about 40% without negatively affecting the drilling efficiency. Another suitable fluid bypass location may be above the BHA, such as shown by location 512*a*. Another location may be above the hydraulic load 506. Also, more than one bypass locations may be utilized to reduce the temperature of the drill string. The amount of the fluid bypass during the drilling mode may be determined by using historical data, knowledge of the wellbores drilled in the same or similar formations, thermal information of the formation, measured downhole parameters or any combination thereof. In one aspect, the controller 570 and/or 140 may utilizes measured parameters, such as pressure, temperature and pressure from sensors P, V and T respectively and other sensors S1-Sn to control the operation of the flow control device 512 to manage the pressure drop and thus the temperature of the BHA as more fully described in relation to FIGS. 7, 8 and 11.

A pause in a drilling operation represents another drilling operation mode. One typical reason for a pause is to add or remove a pipe section. To add or remove a pipe section, the WOB is removed by lifting the bit from the borehole bottom and the fluid circulation is stopped by shutting down the surface pumps. During such a pause, according to one aspect of the method herein, the fluid circulation is continued at the same or a reduced flow rate, the flow control device is opened to divert a substantial portion of the fluid from the drill string to the annulus for a selected time period, which time period typically may be 10-30 minutes, depending upon the drill string temperature gradient and the borehole depth. Such fluid diversion reduces the pressure drop across the BHA in addition to the reduction in pressure across the drill bit, which reduces the temperature gradient along the BHA. The fluid circulation is then stopped by shutting down the surface pumps to add or remove the pipe section. As noted above, such a task typically may take one tenth of an hour. The fluid circulation is started by starting the surface pumps. The flow control device 512 may be reopened if additional fluid circulation is desired before drilling resumes. Due to the reduction in heat generated by reduction in the pressure drop across the BHA, the amount of heat generated by the mud motor in off bottom circulation, the temperature spike that would have occurred within the BHA discussed in reference to FIG. 4 above may be reduced or avoided entirely If drilling is stopped to take an FE measurement, the drill bit is lifted off the borehole bottom. The fluid from the drill string is bypassed into the annulus for a selected time period to reduce to reduce the BHA 560 temperature before taking the FE measurement. The fluid flow rate from the surface may also be reduced as has been previously described relating to the drilling mode. For some FE measurements, such as NMR or seismic measurements, the fluid flow rate may be stopped for taking the FE measurements. For certain other downhole measurements, the fluid flow rate may be continued during the taking of those selected measurements. The drilling operation may be resumed after taking of the above described measurement. The amount of bypass fluid, time period of the bypass and timing of the start and stop of the fluid bypass may be determined by any suitable method, including using historical data, downhole measurements, simulation models or a combination thereof. The use of downhole measurements and simulation for determining such parameters is described later. The above described methods enable the system 100 (FIG. 1) to manage thermal gradient during various drilling operations.

Figure 6A:
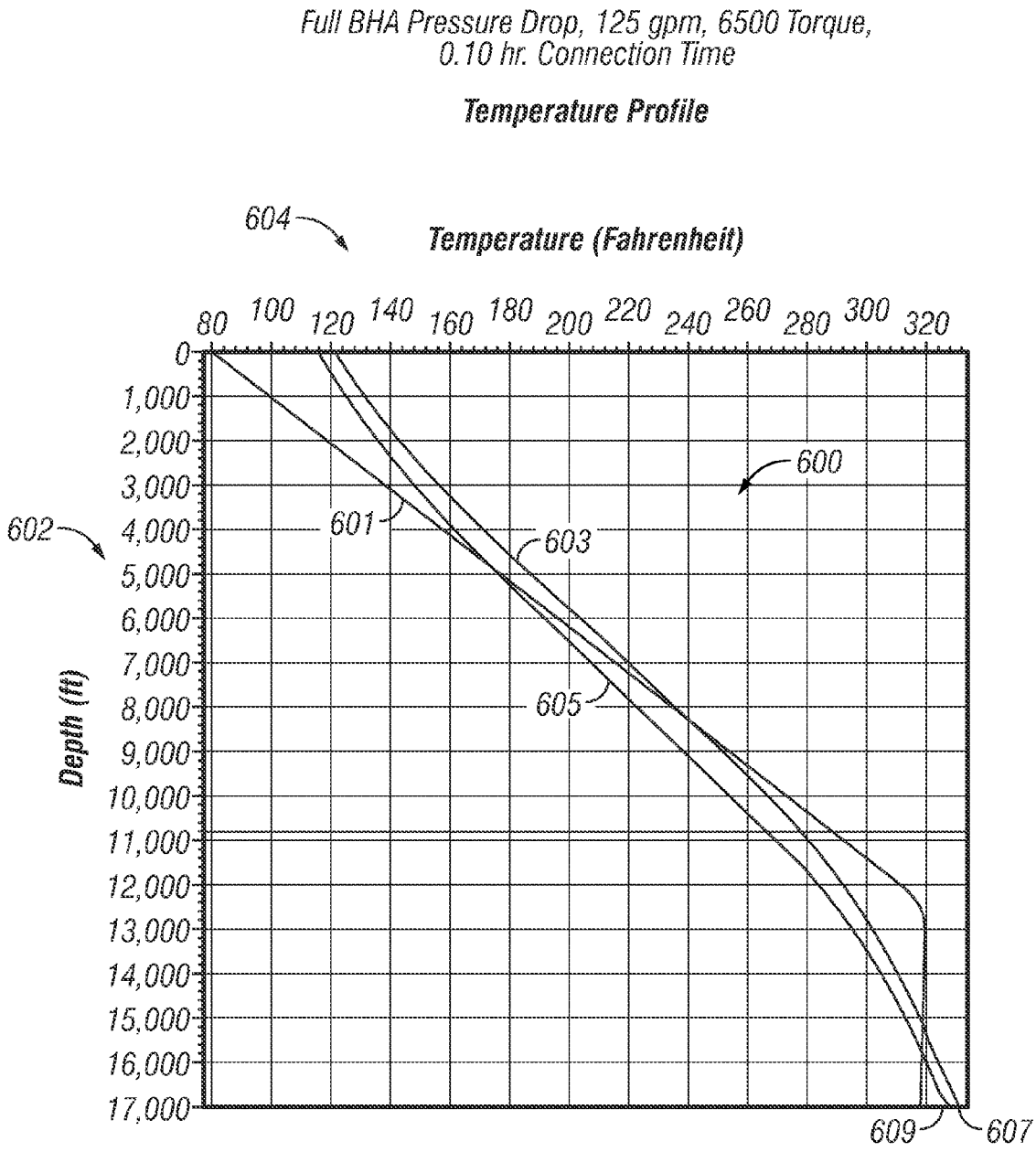
FIG. 6*a* shows exemplary simulated temperature profiles of a BHA, annulus and the formation for a long horizontal borehole as a function of drilling depth when the drilling fluid flow rate is reduced during drilling of the borehole.

FIG. 6*a* shows simulated temperature gradients of the formation, annulus fluid and fluid in BHA when fluid is not bypassed into the annulus above the BHA. The drilling parameters used in FIG. 6A are the same as shown in FIG. 3*b*, except that the flow rate in FIG. 6*a* is 125 gpm compared to 230 gpm in FIG. 3*b*. Curve 601 corresponds to the temperature of the formation, curve 603 to the temperature of the annulus and curve 605 to the temperature of the BHA. Comparison of the temperature gradients shown in FIG. 6*a* (i.e., flow rate of 125 gpm through the BHA) with the temperature gradients shown in FIG. 3*b* (i.e., flow rate of 230 gpm through BHA) shows that the annulus temperature 607 at depth 17,000 ft is about 325° F. compared to annulus temperature 375 of about 347° F., while the temperature 309 of the BHA is about 321° F. compared to about 340° F., which represents approximately a 19° F. temperature drop.

Figure 6B:
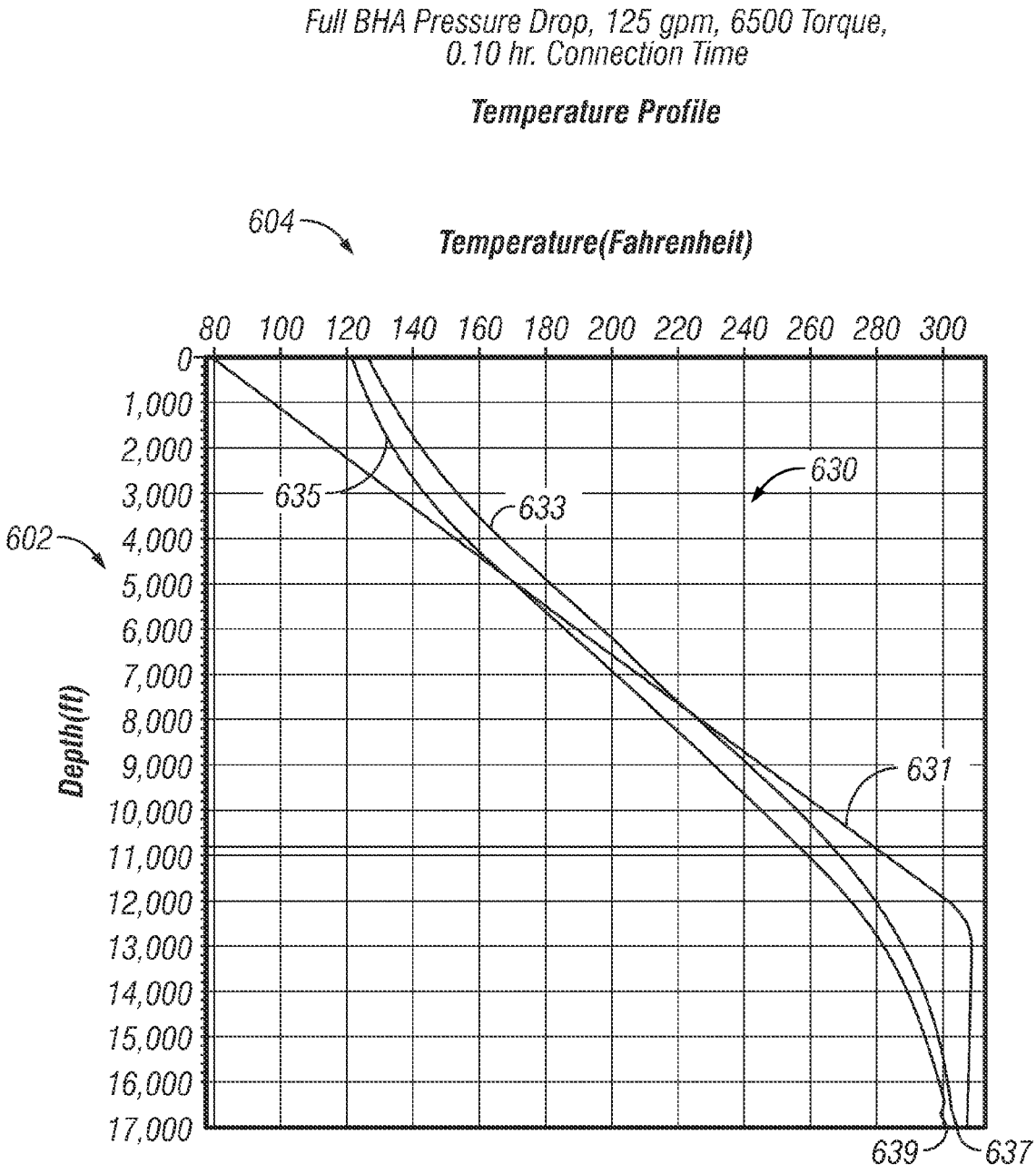
FIG. 6*b* shows exemplary simulated temperature profiles of a BHA, annulus and the formation for a horizontal borehole as a function of drilling depth when fluid flow rate into the drill string is decreased with no pressure drop across the BHA during a drilling operation.

FIG. 6*b* shows simulated temperature profiles of the formation 631, fluid in the annulus 633 and BHA 635 when (a) fluid is diverted above the BHA and (b) there is no pressure drop across the BHA. The connection time to add or remove a pipe section is assumed to be one-tenth of an hour, and the torque 6500 ft-lbs with the fluid flow of 125 gpm. In such a case, at borehole depth of 17,000 ft, the temperature of the fluid in the annulus and the BHA show further reduction compared to the scenario described in FIG. 6A. The temperature 637 of the fluid in the annulus is 308° F. and temperature 639 of the fluid in the BHA are about 304° F., which is about 25° F. less than the formation temperature 631 of about 315° F.

Figure 6C:
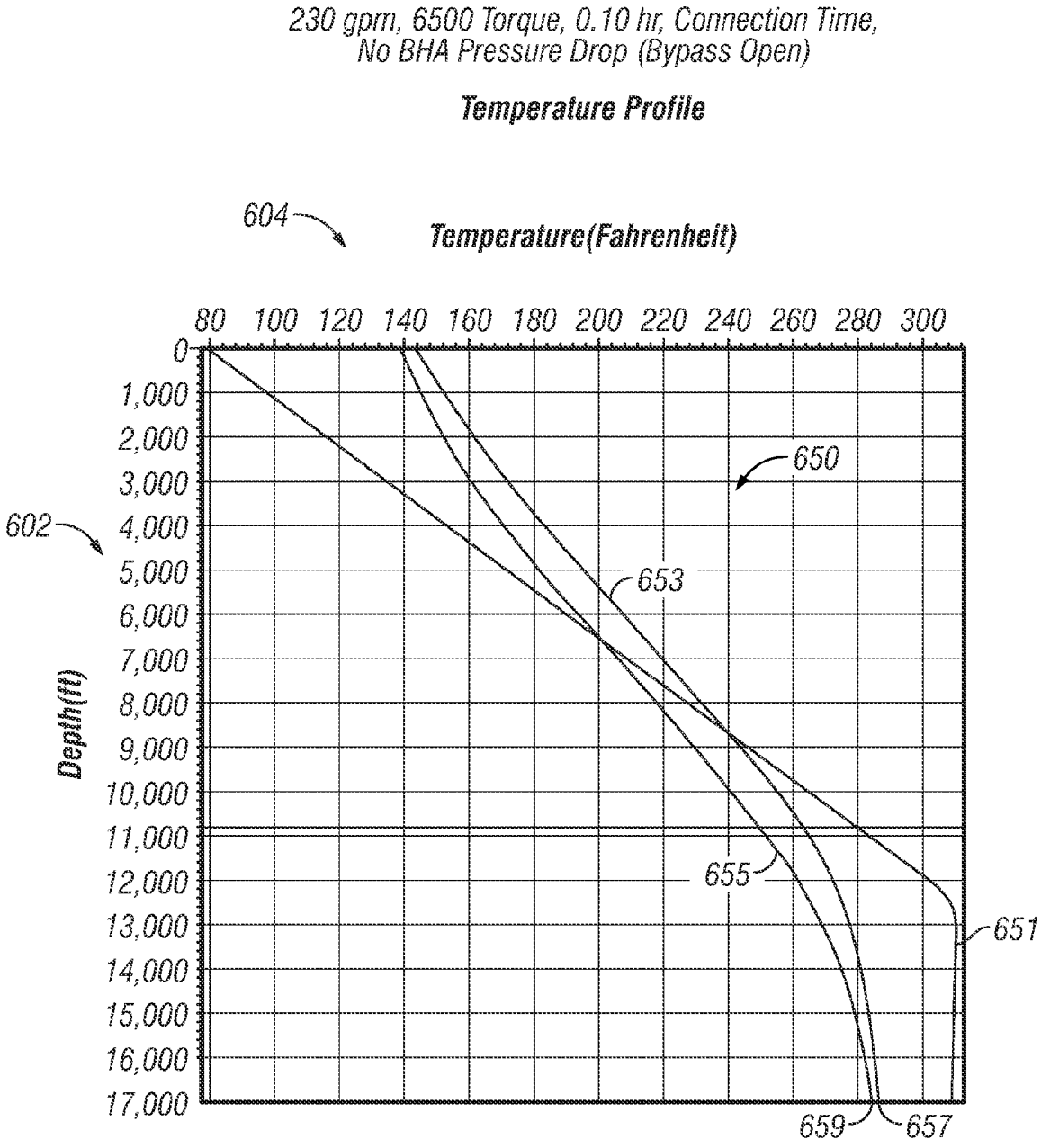
FIG. 6*c* shows exemplary simulated temperature profiles of a BHA, annulus and the formation for a long horizontal borehole as a function of drilling depth when fluid is bypassed to the annulus above the BHA during a drilling operation with no pressure drop across the BHA.

FIG. 6*c* shows simulated temperature profiles of the formation 651, fluid in the annulus 653 and BHA 655 when the fluid circulation is increased from 125 gpm to 230 gpm, with the remaining parameters remaining the same as described in FIG. 6B, the temperature of the annulus fluid 657 is about 290° F. and the temperature 659 of the BHA is about 288° F. compared to the formation temperature 661 of about 315° F.

For the purposes of this disclosure any suitable flow device may be utilized for diverting fluid from the drill string to the annulus. Certain devices that may be utilized are described below as examples, but the disclosure herein is not to be construed to limit the suitable devices to those described herein.

In one aspect, the flow control device may be an electrically-operated, on-demand valve. One embodiment of such a valve is schematically represented in BHA 700 shown in FIG. 7. In one aspect, a telemetry signal 711 from the surface is received by the telemetry module 701 on the BHA 700 and communicated to a downhole processor 703. The downhole processor 703 subsequently sends a control signal 715 to operate the opening and closing of the bypass valve 712 to bypass a selected or desired amount of the fluid to flow into the annulus through the vent (or orifice) 713. In one aspect, the bypass valve 712 may have a minimum associated pressure drop with valve operation, and may be positioned above the mud motor or at any other suitable location in the drill string.

The valve 712 may be designed to minimize plugging due to cuttings present in the annulus fluid. In one aspect, the bypass valve 712 may include an oriented port to prevent cuttings from entering the bypass valve 712 and it may further include a failsafe mode in the closed position. The command signal 711 to operate the bypass valve 712 may be generated at a surface location using temperature measurements made by temperature sensors $T_1, T_2, \ldots T_n$ and telemetered to the surface. The output of pressure sensors $P_1, P_2, \ldots P_n$ and flow rate sensors $V_1$ and $V_2$ below and above the orifice 713 may also be used by the surface controller to monitor the effectiveness of the bypass fluid operation. In another aspect, the bypass valve 712 may be configured to allow a portion of the drilling fluid in any desired amount to pass through the bypass valve and remain in the drill string below the bypass valve to cool tools within the BHA 700. This may be done both during pre-stand addition circulation events or during some of the drilling operation. This allows modulation of the reduction in BHA 700 pressure drop by reducing some of the flowing pressure drop and the associated temperature rise. The bypass valve 712 may be cycled on and off, based on a selected pattern or may be maintained in an intermediate position between full flow and full off.

Figure 7:
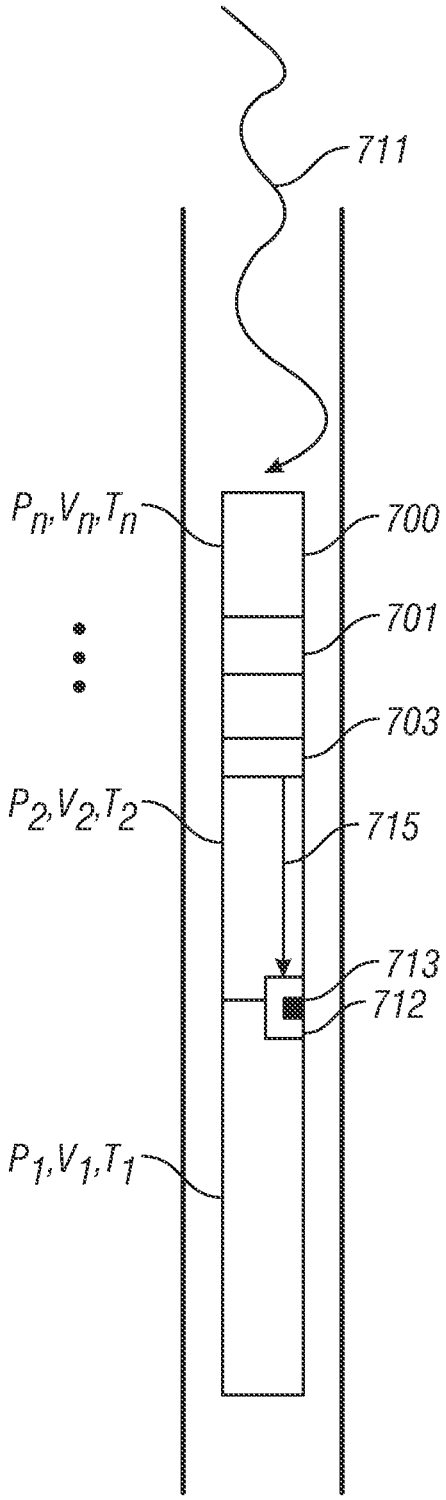
FIG. 7 is a schematic diagram of a flow control device that may be controlled from the surface to selectively circulate drilling fluid from the drill string to the annulus.
Figure 8:
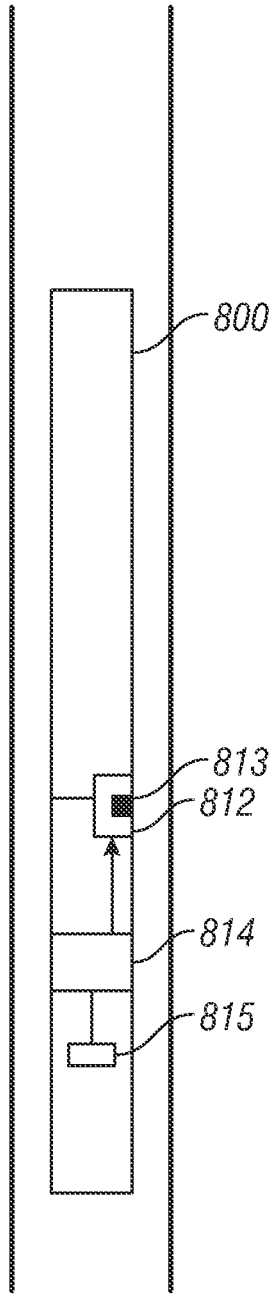
FIG. 8 is a schematic diagram of a flow control device that may be controlled by a downhole controller in a closed-loop fashion to selectively circulate fluid from the drill string to the annulus.

Another embodiment of the flow control device may utilize a bypass valve that may be controlled by a controller in the BHA 800 in response to in-situ measurements in a closed loop fashion. FIG. 8 shows electrically-operated bypass valve 812 with a vent 813 placed above the MWD section. A downhole processor 814 may monitor a temperature probe 815 and automatically adjust the opening of the bypass valve 812 using a program and instructions stored in a storage device in the BHA or at another location to maintain the temperature in the BHA 800 within specified limits. The bypass valve 812 may be opened and closed on demand via communication links in the MWD. The operation of the bypass valve 812 is similar to that of the electrically-operated valve discussed in reference to FIG. 7. The fluid bypass rate may be adjusted depending upon temperature measurements and temperature trends (rising or falling) in the BHA. In one embodiment, the processor 814 may determine an asymptotic value of the temperature using a suitable curve-fitting method. If the asymptotic value of the temperature provided by the asymptote exceeds a tolerance limit of the BHA electronics, the processor initiates a bypass regime to maintain the temperature of the BHA within limits. Any suitable curve-fitting technique may be utilized, including, but not limited to, the techniques that utilize least square fit, exponential functions and sigmoidal functions. The disclosure also contemplates using more than one flow device. Such a configuration is useful by including secondary valves when drilling system includes one or more drill string vibrators (such as vibrator 706 shown in FIG. 7) configured to reduce static friction between the borehole and the drill string in a near horizontal borehole.

In another embodiment, the flow control device may be a mechanical valve. FIG. 9 provides a table showing positions of an exemplary toggle mechanical valve corresponding to certain selected fluid flow rates. In position 1, the drilling fluid flow rate from the surface pump is at a 100% rate, the valve is closed and no fluid is bypassed, i.e., all of the drilling fluid flows through the mud motor and BHA. When the drilling fluid flow rate is reduced at the surface, for example to 40% rate as denoted by position 2, the toggle valve opens. A certain amount of the drilling fluid is vented to the annulus, bypassing the BHA, mud motor and drill bit, thereby reducing the heat generated in the BHA. A minimum flow may be provided to prevent certain types of mud motors from stalling or damage. Additional heat reduction occurs from the reduced flow rate because heat generation from the hydraulic friction loss varies with approximately the square of the flow rate. In position 2, the mud flow can be maintained at a reduced rate for cooling the BHA. When the mud flow rate is increased to 100% rate (position 3), the valve remains open, which cools the fluid due to reduced pressure differential ($\Delta P$) across the BHA. Subsequently, if the mud flow rate is reduced to 20% rate or less, the valve closes and the bypass flow is terminated. The mud flow rate can be raised back to 100% rate so the system is back in position 1 for normal drilling operations. The reduced flow rates shown in FIG. 9 are for explanation purposes and are not to be construed as limitations. In aspects, the flow rate from the flow control device in the open or part open condition may be controlled by fixed nozzles or proportional valves. What is desired is that the transition from position 3 to position 4 takes place at a flow rates below the flow rate transition from position 1 to position 2.

The mechanical bypass valve discussed above may be configured to include a minimum associated pressure drop due to valve operation. It may be positioned below the MWD section 714 and above the mud motor, or above the MWD section 714 as shown in FIG. 7. The mechanical valve design may be configured to minimize plugging due to the cuttings in the fluid circulating through the annulus. The mechanical valve may include an oriented port or shielded slots or other mechanisms to prevent opening of the port in a bed containing cuttings. In one embodiment, an optional check valve may be provided to prevent backflow unless automatic filling of the drill string during tripping into the bore hole is deemed to be a benefit. Also, the valve may include a suitable fail safe mode to place the valve is in a closed position if a failure were to occur.

Figure 10A:
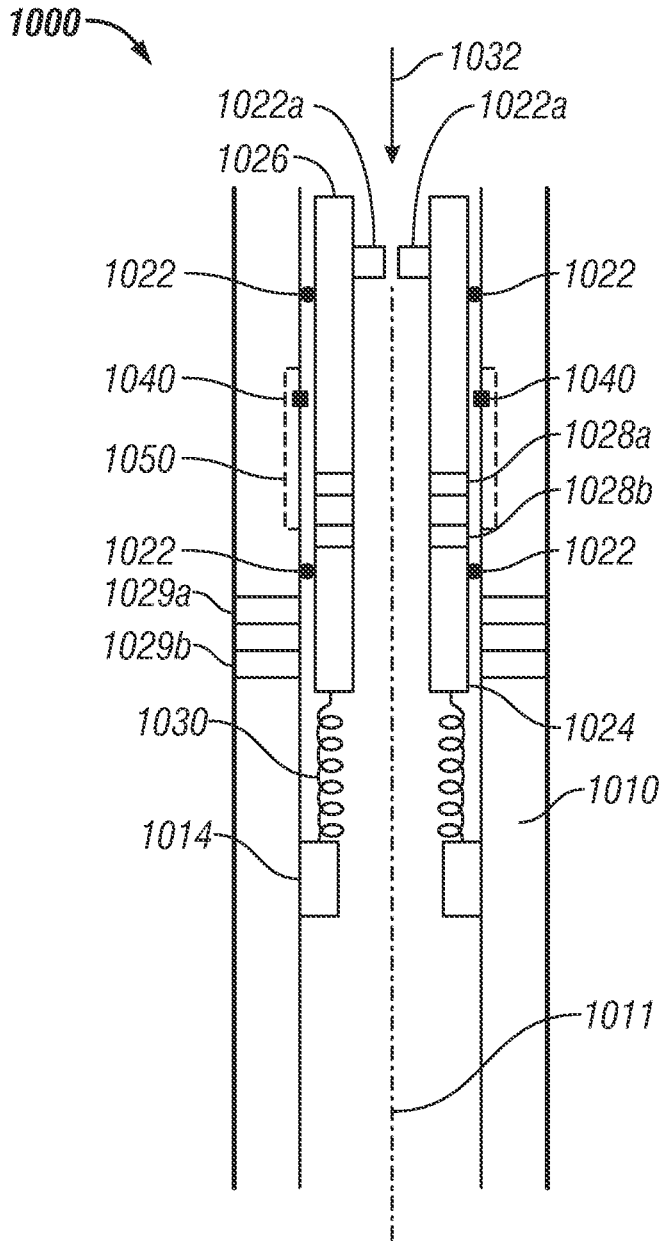
FIG. 10*a* is a schematic diagram of a mechanical flow control device that may be utilized to selectively flow fluid from the drill string to the annulus.
Figure 10B:
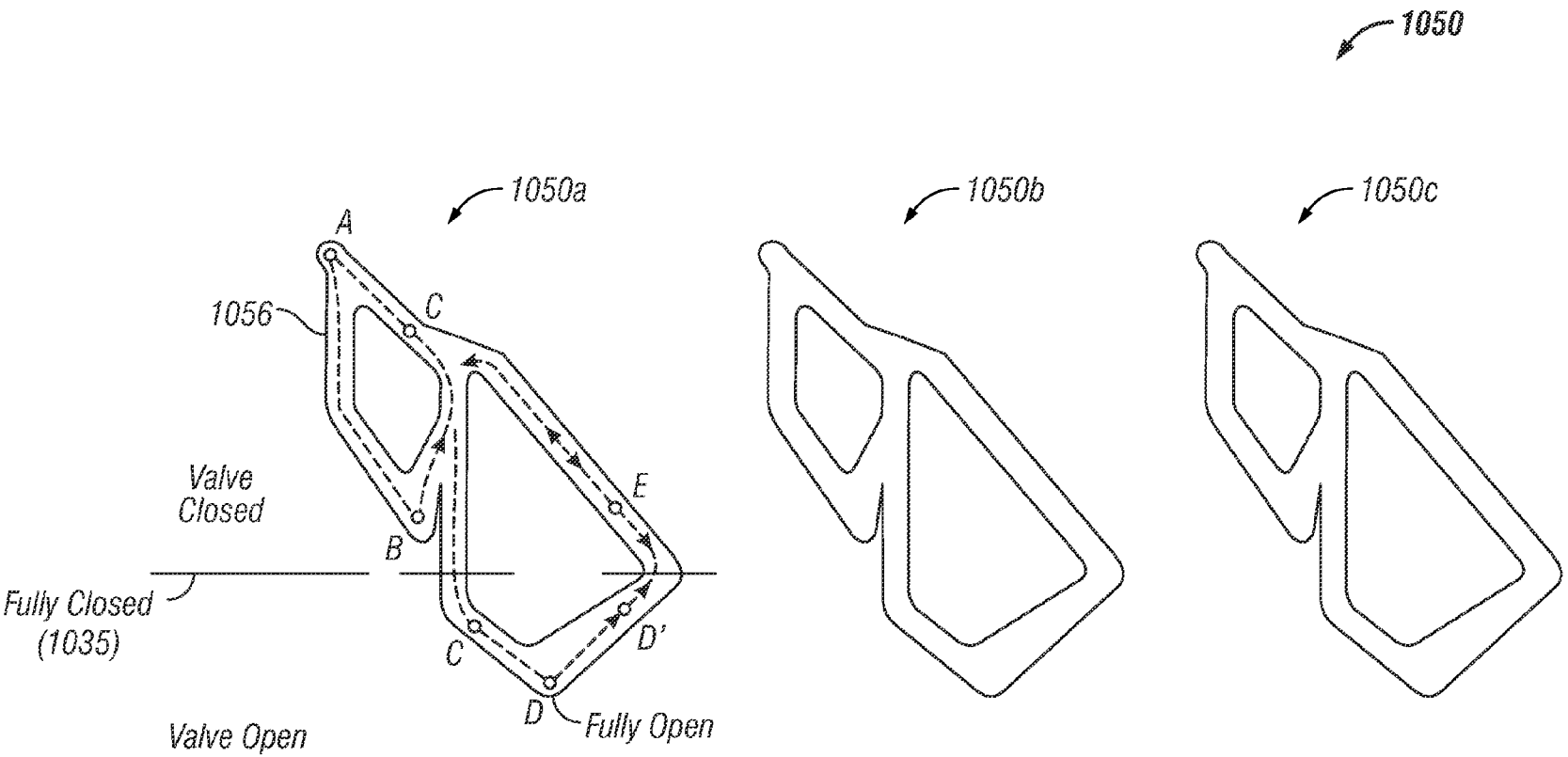
FIG. 10*b* shows exemplary guide channels that may be utilized in the flow control device of FIG. 10*a* for selectively circulating the drilling fluid from the drill string to the annulus.

FIG. 10*a* is a schematic of a mechanical flow control valve 1000 and FIG. 10*b* shows a guide pattern made in a control sleeve of the flow control valve 1000 to set the bypass fluid flow at selected levels. The flow control valve 1000 is shown to include an outer sleeve or housing 1010 having a longitudinal axis 1011. A control sleeve 1020 slides inside the outer sleeve 1010 along the o-rings 1022. The control sleeve 1020 is coupled at its bottom end 1024 to a spring 1030 mass, which rests on a base 1014 associated with the outer sleeve 1010. One or more force application members 1026 coupled to the inner sleeve 1020 provide force to move the inner sleeve 1020 downward toward the spring 1030 in response to the flow of the fluid 1032 supplied by the surface pumps. One or more guide pins 1040 associated with the outer surface of the control sleeve 1020 move within their separate guide channels 1050 associated with the inner side of the outer sleeve 1010. The guide pins 1040 may be attached to the control sleeve 1020 and the guide channels may be made in the body of the outer sleeve 1010. The control sleeve 1020 includes one or more fluid flow passages 1028*a*, 1028*b* that allow the fluid 1032 to flow from inside the control sleeve 1020 to outside the outer sleeve 1010 via one or more flow passages 1029*a*, 1029*b*.

The operation of the flow control device 1000 is described in reference to FIG. 10*b*. The flow control device 1000 is assumed to include three pins 1040. FIG. 10*b* shows exemplary guide channels 1050*a*, 1050*b* and 1050*c* corresponding the three pins 1040*a*, 1040*b* and 1040*c*. All such guide channels have the same pattern and therefore the operation of the flow control device 1000 is described in reference to guide channel 1050*a*. The pin 1040*a* moves inside the guide channel 1050*a* in response to force applied by the force application members 1026 on the control sleeve 1020, which is a function of the fluid flow through the control valve 1000. Initially, when the mud pumps are off, the pin 1040*a* is at position A of the guide channel 1052*a* and the control valve 1000 is closed due to the force applied on the control sleeve 1020 by the spring 1030. When the pumps are turned on (full flow), the pin moves from position A to position B and the control sleeve 1020 moves downward. The flow control device 1000 remains closed because none of the flow passages 1028*a*, 1028*b* line up with the passages 1029*a*, 1029*b*. Line 1035 indicates the guide channel 1050*a* location above which the valve 1000 is closed and below which it is open. If the fluid flow is reduced with the pin in position B, the pin moves to position C, and upon turning the pumps off, moves the pin to position A. If the fluid flow is increased when the pin is in position C, the pin moves toward position C'. When the pin is in position C', the fluid flows from inside the flow control sleeve 1010 to the annulus via one of the aligned passages 1028*a*, 1028*b* and 1029*a*, 1029*b*. Increasing the fluid flow causes the pin to reach position D, causing the valve to be in the full open position. Reducing the fluid flow when the pin is at position D causes the pin to move toward position D' and will partially close valve 1000. Further reduction in the fluid flow causes the pin to move toward position E where valve 1000 would be closed. If the pumps are shut down when the pin is in position E, the pin moves to position A, resetting the valve to the base position whereby increasing or starting the flow will cause valve 1000 to remain closed. When the pin is anywhere below the line 1035, the flow control device is configured to bypass the fluid 1032 into the annulus. The amount of the fluid depends upon the size of the passages 1028*a*, 1028*b*, 1029*a* and 1029*b* and the position of flow control sleeve below the reference line 1035.

Figure 11:
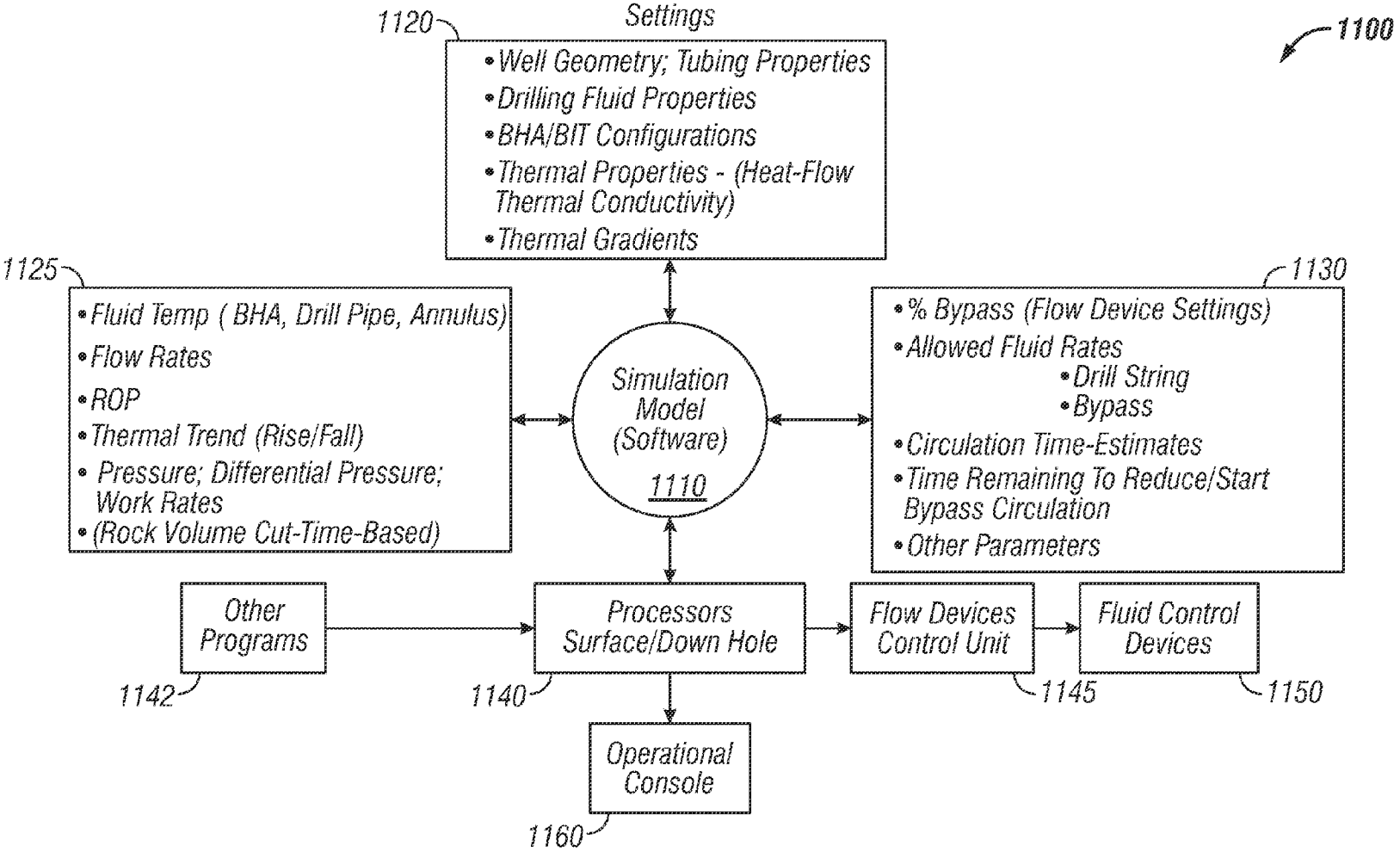
FIG. 11 is a schematic diagram of an exemplary computer-based system that may be utilized to provide settings or instructions for the flow control device to circulate the drilling fluid from the drill string to the annulus according to one embodiment of the disclosure.

FIG. 11 shows a flow diagram of a simulation system 1100 that may be utilized to determine the desired fluid flow through the flow control devices. In one aspect, the system 1100 may include a simulation model 1110 that utilizes a variety of inputs and provides information relating the thermal management along the BHA and the drilling tubular. One type of information (data) used by the simulation model 1110 includes settings 1120 of various components that interact during drilling of the borehole. Such settings may include, but are not limited to, wellbore geometry, properties of the drilling tubing, BHA configuration and properties, drilling fluid properties, and thermal properties, such as heat flow and thermal gradient. Another type of information utilized by the simulation model 1110 includes parameters that relate to heat generation and heat distribution in the borehole. Such parameters may include, but are not limited to, fluid temperature at one or more locations in the borehole and the BHA, rate of penetration, fluid flow rate, thermal trend (rise and fall of temperature), pressure drops or differential pressures across various components along the drill string and work rate (e.g., time-based volume of rock cut). During a drilling operation, a processor in the control unit (such as control unit 170 in the BHA and/or control unit 140 at the surface utilizing the programs 1142, provides real-time information relating to temperature profile, pressure drops, fluid flow rates, etc. to the simulation model 1110 and determines therefrom one or more outputs 1130, which may include a new flow device setting, time remaining for the flow bypass, etc. The control unit 170 and/or 140 may send such determined information to an operator for implementing the changes (Block 1160) or automatically take actions such as setting the flow device to the new setting (Block 1145), changing the fluid pump rate, turning on or off the mud pump at the surface, etc. The controllers 170 and/or 140 may continue to monitor the thermal distribution along the BHA and any other section of the drill string continuously or periodically and utilizing new values of such parameters obtain new output values 1130 using the simulation model 1110. The controller 170 and/or 140 may then implement the new setting as described above.

Thus, in aspects, the disclosure provides a method of drilling a wellbore that may include: drilling a borehole using a drill string including a BHA by circulating a fluid through the drill string and an annulus between the drill string and the borehole; pausing drilling; continuing circulating the fluid; diverting a selected portion of the fluid from the drill string into the annulus at a selected location above the drill bit to reduce temperature of the BHA; and resuming drilling of the borehole. In one aspect, the method may further include stopping circulation before resuming the drilling; and performing an operation when the circulation is stopped. In one aspect, the operation may include adding a pipe section in the drill string or removing a pipe sections from the drill string.

Another method of drilling a borehole according to the disclosure may include: drilling a borehole using a drill string including a BHA by circulating a fluid through the drill string and an annulus between the drill string and the borehole; and diverting a selected amount of the fluid from the drill string to the annulus at a selected location above the drill bit to reduce pressure drop across the BHA to reduce temperature of the BHA. The method may further include diverting the fluid in response to a parameter of interest. In one aspect, the parameter my be any suitable parameter, including, but not limited to temperature, pressure, and pressure drop. The method may further include determining the fluid to be diverted using a model that may utilize at least one parameter, including, but not limited to: a temperature of the BHA, a pressure gradient; a pressure drop across the BHA, a pressure gradient a differential pressure across at least a portion of the drill string, a fluid volume, a fluid flow rate through a flow control device, an opening of the flow control device, a time period and a work rate.

In other aspects, an apparatus for drilling a borehole according to one embodiment may include a drill string having a BHA and a flow control device at a selected location in the drill string to selectively divert drilling fluid from the drill string to an annulus during a drilling operation to reduce pressure drop across a selected portion of the drill string to reduce the temperature of at least a portion of the BHA. In one aspect, the flow control device may be an electrically-controlled device. In another aspect, a controller may control the fluid bypass in response to one or more parameters of interest. In another aspect, the flow control device may be a device that may be operated by changing flow of the drilling fluid from the surface. In each case, a controller may be utilized to circulate and divert the fluid. A model may be utilized by a controller to execute the various operations described herein.

The foregoing description is directed to particular embodiments of the present disclosure for the purpose of illustration and explanation it will be apparent, however, to one skilled in the art that many modifications and changes to the embodiments set forth above are possible without departing from the scope and the spirit of the disclosure. It is intended that the following claims be interpreted to embrace all such modifications and changes.

The invention claimed is:

1. A method of drilling a borehole, comprising:

drilling the borehole using a drill string that includes a tubular and a bottomhole assembly having a drill bit at an end thereof by circulating a fluid through the drill string and an annulus between the drill string and the borehole; and diverting a selected portion of the fluid from the drill string into the annulus at a selected location above the drill bit to selectively bypass a portion of the bottomhole assembly or drill bit that causes heat to be added to the drilling fluid via frictional forces and to reduce pressure drop across at least a portion of the bottomhole assembly, wherein the diverting the selected portion of the fluid reduces a temperature of the bottomhole assembly when the temperature of the bottomhole assembly and a temperature of the circulation fluid are both greater than a temperature of a formation proximate the bottomhole assembly.

2. The method of claim 1 further comprising vibrating the drill string to maintain the drill string in a dynamic friction mode.

3. The method of claim 1 wherein diverting the fluid comprises diverting the fluid at a location in the drill string that is one selected from the group consisting of: (i) above a mud motor in the bottomhole assembly; (ii) below a measurement-while-drilling tool in the bottomhole assembly; (iii) between a mud motor and a measurement-while-drilling tool; and (iv) at a suitable location in the tubular.

4. The method of claim 1 wherein diverting the fluid comprises using a flow control device to divert the selected portion of the fluid into the annulus.

5. The method of claim 4 wherein the flow control device is selected from a group consisting of: (i) a mechanically-controlled device; (ii) an electrically-controlled device; (iii) a thermally-controlled device and (iv) a flow control device responsive to a command signal.

6. The method of claim 1 wherein diverting the fluid is performed as one selected from the group consisting of: (i) during drilling of the borehole; (ii) when a drill pipe segment is being added to or removed from the drill string; (iii) before adding a drill pipe segment into the drill string; (iv) after removing a drill pipe segment from the drill string; and (v) when a measurement is being made.

7. The method of claim 1 further comprising using a controller to control diverting of the fluid, and wherein diverting the fluid comprises diverting the fluid in response to a parameter.

8. The method of claim 7 wherein the parameter is selected from a group consisting of a: (i) temperature; (ii) temperature gradient; (iii) pressure; (iv) pressure gradient; (v) differential pressure; (vi) fluid volume; (vii) flow rate; (viii) work rate; (ix) time period; and (x) historical information.

9. The method of claim 1 wherein diverting the fluid is performed in one of a: (i) highly deviated borehole; and (ii) horizontal borehole.

10. An apparatus for drilling a borehole, comprising:

a drill string including a tubular and a bottomhole assembly including a drill bit at an end of the tubular, wherein a fluid supplied into the tubular in a borehole circulates from the tubular to the surface via an annulus between the bottomhole assembly and the borehole and wherein the fluid flow exhibits a pressure drop across the bottomhole assembly that increases the temperature of the bottomhole assembly;

a flow control device configured to divert the fluid from the drill string into the annulus to selectively bypass a portion of the bottomhole assembly or drill bit that causes heat to be added to the drilling fluid via frictional forces and to reduce a pressure drop across the bottomhole assembly during a downhole operation; and a controller configured to control the flow control device and to selectively divert the selected portion of the fluid to reduce a temperature of the bottomhole assembly based on a condition where the temperature of the bottomhole assembly and a temperature of the circulation fluid are both greater than a temperature of a formation proximate the bottomhole assembly.

11. The apparatus of claim 10 further comprising a device at a surface configured to provide torsional or twisting motion to the drill string to maintain the drill string in a dynamic friction mode.

12. The apparatus of claim 10, wherein the flow control device is located at one of: (i) above a mud motor in the bottomhole assembly; (ii) below a measurement-while-drilling tool in the bottomhole assembly; and (iii) between a mud motor and a measurement-while-drilling tool; (iv) a suitable location in the tubular.

13. The apparatus of claim 10, wherein the flow control device is selected from a group consisting of: (i) a mechanically-controlled flow control device; (ii) an electrically-controlled flow control device; and (iii) a thermally-controlled flow controlled device; (iv) a device responsive to a command signal.

14. The apparatus of claim 10, wherein the controller is configured to control the flow control device at one selected from the group consisting of: (i) during drilling of the borehole; (ii) when a drill pipe segment is being added to or removed from the drill string; (iii) before a drill pipe segment is added to the drill string; (iv) after removing a drill pipe segment from the drill string; (v) when a measurement is being made with the drill string being substantially stationary; and (vi) during a pause in drilling of the borehole.

15. The apparatus of claim 10 wherein the controller controls the flow control device in response to one selected from the group consisting of a: (i) temperature; (ii) temperature gradient; (iii) pressure; (iv) pressure gradient; (v) fluid volume;

(vi) work rate; (vii) time period; and (viii) flow rate.

16. The apparatus of claim 15 further comprising a sensor configured to provide measurements relating to one selected from the group consisting of: (i) temperature; (ii) temperature gradient; (iii) pressure; (iv) pressure gradient; (v) fluid volume; and (vi) flow rate through the flow control device.

17. The apparatus of claim 10 further comprising a model configured to generate a parameter, for use by the controller to control diverting of the fluid, that is one selected from the group consisting of: (i) a time period; (ii) a start time and an end time; (iii) a flow rate; (iv) an amount of the fluid to be diverted; (v) a setting relating to the flow control device; (vi) pressure; (vii) pressure differential; (viii) pressure gradient; (ix) temperature; (x) temperature gradient; (xi) work rate; and (xii) historical information.

18. The apparatus of claim 10 further comprising an additional flow control device, wherein the flow control device diverts the fluid from the bottomhole assembly into the annulus and the additional device diverts the fluid from a location above the bottomhole assembly.

* * * * *